US012721382B2

(12) United States Patent
Silbert et al.

(10) Patent No.: US 12,721,382 B2
(45) Date of Patent: Sep. 1, 2026

(54) ATHLETIC GARMENT

(71) Applicant: LULULEMON ATHLETICA CANADA INC., Vancouver (CA)

(72) Inventors: Jessica McHale Silbert, Vancouver (CA); Peter Yingruihou Tierney, Vancouver (CA)

(73) Assignee: Lululemon Athletica Canada Inc., Vancouver (CA)

( * ) Notice: Subject to any disclaimer, the term of this patent is extended or adjusted under 35 U.S.C. 154(b) by 14 days.

(21) Appl. No.: 18/798,415

(22) Filed: Aug. 8, 2024

(65) Prior Publication Data

US 2025/0049150 A1 Feb. 13, 2025

Related U.S. Application Data

(60) Provisional application No. 63/519,042, filed on Aug. 11, 2023.

(51) Int. Cl.

| | |
|---|---|
| ***A41D 1/04*** | (2006.01) |
| ***A41D 27/20*** | (2006.01) |
| ***A41D 31/06*** | (2019.01) |
| *A41D 31/32* | (2019.01) |

(52) U.S. Cl.

CPC ..... *A41D 1/04* (2013.01); *A41D 27/20* (2013.01); *A41D 31/06* (2019.02); *A41D 31/32* (2019.02)

(58) Field of Classification Search

CPC ..... A41D 1/04; A41D 31/32; A41D 27/20; A41D 13/0051

See application file for complete search history.

(56) References Cited

U.S. PATENT DOCUMENTS 6,263,510 B1 * 7/2001 Bay ..... A41D 27/28 2/93
2009/0289046 A1 * 11/2009 Richmond ..... H01M 50/24 429/61
2016/0374411 A1 * 12/2016 Brooks ..... A61F 7/007 165/104.21

(Continued)

FOREIGN PATENT DOCUMENTS

KR 20240169953 A * 12/2024 ..... A41D 1/04

OTHER PUBLICATIONS

KR20240240169953A_Chae Hyeong Seok (Year: 2024).*

*Primary Examiner* — Alissa L Hoey
*Assistant Examiner* — Akwokwo Olabisi Redhead
(74) *Attorney, Agent, or Firm* — Norton Rose Fulbright Canada LLP; Thomas Sutherland

(57) ABSTRACT

According to an aspect, there is provided a support garment including a front portion having a right front portion and a left front portion. The right front portion and the left front portion being separated and forming a front opening of the body to allow the wearer to put the garment on or to remove it. The right front portion including a right chest panel and a right abdomen panel. The left front portion including a left chest panel and a left abdomen panel. The support garment further including an adjustable chest fastener and an adjustable abdomen fastener. According to an aspect, there is provided a support garment or a temperature control athletic including at least one pocket bag formed at least in the support garment, the at least one pocket bag having an access opening and configured to store at least one thermal regulating element.

19 Claims, 16 Drawing Sheets

(56) References Cited

U.S. PATENT DOCUMENTS

| | | | | |
|---|---|---|---|---|
| 2022/0256946 | A1* | 8/2022 | Yamauchi | A41D 1/04 |
| 2024/0188661 | A1* | 6/2024 | Boddaert | A45C 13/1046 |
| 2025/0255363 | A1* | 8/2025 | Uchida | A41D 13/0056 |

* cited by examiner

ATHLETIC GARMENT

CROSS-REFERENCE

This application claims priority to U.S. provisional patent application No. 63/519,042, entitled "ATHLETIC GARMENT", and filed on Aug. 11, 2023, the entire contents of which are incorporated herein by reference.

FIELD

The garments described herein generally relate to upper body garments and more specifically to improvements in the field of support garments for exercise.

INTRODUCTION

Vests and other garments can be worn during exercise such as running or other activities. These garments can offer places to store items during a run to avoid pitfalls of other storage options such as backpacks which may bounce around while running.

Although the functional purpose of vests and athletic garments are well recognized, providing both function and proper fit remains a challenge. Current industry standards often involve designing garments in a unisex manner, and with a narrow range of body types in mind. Consequently, many garments do not provide adequate fit for all body types or for all genders. As such, improved garments are needed that provides function and proper fit for a wider range of wearers.

SUMMARY

Described herein are garments that include a front portion made up of four panels (e.g., two upper/chest panels and two lower/abdomen panels) which offer attachment points generally across the user's chest and the user's abdomen. Such design configurations can enable a closer fit across both the user's chest and the user's abdomen to accommodate a greater number of body types. The separated panelling can provide a garment that can be tightened without undue material bunching up and affecting the fit. In some embodiments, the garments described herein can comfortably accommodate and support user's of a variety of chest sizes during a variety of activities. These garments may be able to further secure items within them without undue or uncomfortable movement during use. Additional improvements are also described herein which may be suitable for the garments described herein and may further improve other garments.

According to an aspect, there is provided a support garment including a body configured to cover at least a portion of a torso of a wearer and having an outer surface and an inner surface, the inner surface facing the wearer torso. The body including a back portion having a back panel with a top side forming a portion of a neck opening, a bottom side forming a portion of a torso opening, a right lateral side and a left lateral side, and a front portion having a right front portion configured to cover a right side of the wearer torso and having a lateral side connected directly or indirectly to the right lateral side of the back panel and a left front portion configured to cover a left side of the wearer torso and having a lateral side connected directly or indirectly to the left lateral side of the back panel. The right and the left front portions connected to the back portion to form the body with corresponding right and left arm openings and torso opening. The right front portion and the left front portion being separated and forming a front opening of the body to allow the wearer to put the garment on or to remove it. The right front portion including a right chest panel and a right abdomen panel, the right chest panel and the right abdomen panel each being connected directly or indirectly to the right lateral side of the back panel along at least part of their respective lateral sides and each having a respective top edge, a bottom edge, and a medial edge. The left front portion including a left chest panel and a left abdomen panel, the left chest panel and the left abdomen panel each being connected directly or indirectly to the left lateral side of the back panel along at least part of their respective lateral sides and each having a respective top edge, a bottom edge, and a medial edge. The support garment further including an adjustable chest fastener configured to link the right chest panel and the left chest panel bringing the right chest panel and left chest panel from an open configuration to a closed configuration and an adjustable abdomen fastener configured to link the right abdomen panel and the left abdomen panel bringing the right abdomen panel and left abdomen panel from an open configuration to a closed configuration.

In some embodiments, the right abdomen panel is configured to at least partially overlay the right chest panel and the left abdomen panel is configured to overlay the left chest panel.

In some embodiments, the right chest panel is configured to at least partially overlay the right abdomen panel and the left chest panel is configured to overlay the left abdomen panel.

In some embodiments, the right abdomen panel is attached to the right chest panel such that the top edge of the right abdomen panel at least partially overlaps the bottom edge of the right chest panel and left abdomen panel is attached to the left chest panel such that the top edge of the left abdomen panel at least partially overlaps the bottom edge of the left chest panel.

In some embodiments, the right abdomen panel is attached to the right chest panel such that the bottom edge of the right chest panel at least partially overlaps the top edge of the right abdomen panel and left abdomen panel is attached to the left chest panel such that the bottom edge of the left chest panel at least partially overlaps the top edge of the left abdomen panel.

In some embodiments, the chest fastener includes a right chest fastening element coupled to the medial edge of the right chest panel of the right front portion and a left chest fastening element coupled to the medial edge of the left chest panel of the left front portion, the right chest fastening element being configured to engage the left chest fastening element and to disengage the left chest fastening element to separate and bring the right chest panel and the left chest panel in open configuration, the chest fastener further including a chest adjusting element coupled to the right and/or the left chest fastening element to adjust a position of the chest fastener along the medial edges of the right and left chest panels or to adjust a closeness of the right and the left chest panels when in the closed position, and the abdomen fastener including a right abdomen fastening element coupled to the medial edge of the right abdomen panel of the right front portion and a left abdomen fastening element coupled to the medial edge of the left abdomen panel of the left front portion, the right abdomen fastening element being configured to engage the left abdomen fastening element and to disengage the left abdomen fastening element to separate and bring the right abdomen panel and the left abdomen panel in open configuration, the abdomen fastener further including an abdomen adjusting element coupled to the right and/or the left abdomen fastening element to adjust a position of the abdomen fastener along the medial edges of the right and left abdomen panels or to adjust a closeness of the right and the left abdomen panels when in the closed position.

In some embodiments, the support garment further includes a right chest rail connected to the right chest panel in proximity to the medial edge of the right chest panel and a left chest rail connected to the left chest panel in proximity to the medial edge of the left chest panel, the right chest fastening element of the chest fastener slidably mounted to the right chest rail and the left chest fastening element of the chest fastener slidably mounted to the left chest rail, the position of the chest fastener adjusted by sliding the right chest fastening element along the right chest rail and sliding the left chest fastening element along the left chest rail.

In some embodiments, the support garment further includes a right abdomen rail connected to the right abdomen panel in proximity to the medial edge of the right abdomen panel and a left abdomen rail connected to the left abdomen panel in proximity to the medial edge of the left abdomen panel, the right abdomen fastening element of the abdomen fastener slidably mounted to the right abdomen rail and the left abdomen fastening element of the abdomen fastener slidably mounted to the left abdomen rail, the position of the abdomen fastener adjusted by sliding the right abdomen fastening element along the right abdomen rail and sliding the left abdomen fastening element along the left abdomen rail.

In some embodiments, the support garment further includes at least one of a right side adjuster having a first part connected to a lower portion of the right abdomen panel and a second part positioned on a lower portion of the back panel and a left side adjuster having a first part connected to a lower portion of the left abdomen panel and a second part positioned on the lower portion of the back panel, the right and the left side adjusters being configured to fit the front and back portions.

In some embodiments, the back panel includes an outer panel and an inner panel, the outer and the inner panels connected to form a back pocket bag therein between with an access opening, the back pocket bag configured to store items.

In some embodiments, the back panel further includes at least one securing retainer to secure the items when positioned in the back pocket bag.

In some embodiments, the outer panel is a pocket panel connected to the inner panel to form the back pocket bag.

In some embodiments, the at least one securing retainer is coupled to the back inner panel and/or the back outer panel in proximity to the access opening.

In some embodiments, the inner panel includes an absorbent material.

In some embodiments, an outer surface of the outer panel includes a reflective material.

In some embodiments, the inner panel includes a mesh.

In some embodiments, the support garment further includes one or more front pocket panels connected to at least one of the right chest panel, the left chest panel, the right abdomen panel, and the left abdomen panel, each front pocket panel forming a front pocket bag and an entrance opening of the front pocket bag.

In some embodiments, an inner panel of the front pocket bag includes an absorbent material.

In some embodiments, an outer surface of the one or more front pocket panels includes a reflective material.

In some embodiments, an inner panel of the front pocket bag includes a mesh.

In some embodiments, the support garment further includes a right side panel having a top side forming portion of the right arm opening, a bottom side forming portion of the torso opening, a first side connected to the lateral side of the right abdomen panel and a second side connected to a portion of the right lateral side of the back panel, and a left side panel having a top side forming portion of the left arm opening, a bottom side forming portion of the torso opening, a first side connected to the lateral side of the left abdomen panel and a second side connected to a portion of the left lateral side of the back panel.

In some embodiments, the support garment further includes at least one of a right side pocket panel connected to the right side panel to form a right side pocket bag and a left side pocket panel connected to the left side panel to form a left side pocket bag.

In some embodiments, an inner panel of the right side pocket bag and/or the left side pocket bag includes an absorbent material.

In some embodiments, an outer surface of the right side pocket panel and/or the left side pocket panel includes a reflective material.

In some embodiments, an inner panel of the right side pocket bag and/or the left side pocket bag includes a mesh.

In some embodiments, the garment is a vest, a jacket, a shirt, a life-vest, a harness, or a coat.

In some embodiments, the garment is an athletic vest.

In some embodiments, the garment further includes a left sleeve and a right sleeve.

According to an aspect, there is provided a temperature control athletic garment including a back portion configured to cover a portion of a back of a wearer torso and comprising at least one back panel with a top side forming a portion of a neck opening, a bottom side forming a portion of a torso opening, a right lateral side and a left lateral side, and a front portion having a right front portion configured to cover a right side of the wearer torso and having a lateral side connected directly or indirectly to the right lateral side of the back panel, and a left front portion configured to cover a left side of the wearer torso and having a lateral side connected directly or indirectly to the left lateral side of the back panel. The right and the left front portions connected to the back portion to form a garment body with corresponding right and left arm openings and torso opening. The right front portion and the left front portion being separated and forming a front opening of the garment body to allow the wearer to put the garment on or to remove it. The right front portion including a right chest panel and a right abdomen panel, the right chest panel and the right abdomen panel each being connected directly or indirectly to the right lateral side of the back panel along at least part of their respective lateral sides and each having a respective top edge, a bottom edge and a medial edge. The left front portion including a left chest panel and a left abdomen panel, the left chest panel and the left abdomen panel each being connected directly or indirectly to the left lateral side of the back panel along at least part of their respective lateral sides and each having a respective top edge, a bottom edge, and a medial edge. The athletic garment further including an adjustable chest fastener configured to link the right chest panel and the left chest panel bringing the right chest panel and left chest panel from an open configuration to a closed configuration, an adjustable abdomen fastener configured to link the right abdomen panel and the left abdomen panel bringing the right abdomen panel and left abdomen panel from an open configuration to a closed configuration, and at least one pocket bag formed at least in at least one of the at least one back panel, the right chest panel, the right abdomen panel, the left chest panel and the left abdomen panel, the at least one pocket bag having an access opening and configured to store at least one thermal regulating element.

In some embodiments, the right abdomen panel is configured to at least partially overlay the right chest panel and the left abdomen panel is configured to overlay the left chest panel.

In some embodiments, the right chest panel is configured to at least partially overlay the right abdomen panel and the left chest panel is configured to overlay the left abdomen panel.

In some embodiments, the right abdomen panel is attached to the right chest panel such that the top edge of the right abdomen panel at least partially overlaps the bottom edge of the right chest panel and left abdomen panel is attached to the left chest panel such that the top edge of the left abdomen panel at least partially overlaps the bottom edge of the left chest panel.

In some embodiments, the right abdomen panel is attached to the right chest panel such that the bottom edge of the right chest panel at least partially overlaps the top edge of the right abdomen panel and left abdomen panel is attached to the left chest panel such that the bottom edge of the left chest panel at least partially overlaps the top edge of the left abdomen panel.

In some embodiments, the chest fastener includes a right chest fastening element coupled to the medial edge of the right chest panel of the right front portion and a left chest fastening element coupled to the medial edge of the left chest panel of the left front portion, the right chest fastening element being configured to engage the left chest fastening element and to disengage the left chest fastening element to separate and bring the right chest panel and the left chest panel in open configuration, the chest fastener further comprising a chest adjusting element coupled to the right and/or the left chest fastening element to adjust a position of the chest fastener along the medial edges of the right and left chest panels or to adjust a closeness of the right and the left chest panels when in the closed position, and the abdomen fastener includes a right abdomen fastening element coupled to the medial edge of the right abdomen panel of the right front portion and a left abdomen fastening element coupled to the medial edge of the left abdomen panel of the left front portion, the right abdomen fastening element being configured to engage the left abdomen fastening element and to disengage the left abdomen fastening element to separate and bring the right abdomen panel and the left abdomen panel in open configuration, the abdomen fastener further comprising an abdomen adjusting element coupled to the right and/or the left abdomen fastening element to adjust a position of the abdomen fastener along the medial edges of the right and left abdomen panels or to adjust a closeness of the right and the left abdomen panels when in the closed position.

In some embodiments, the garment further includes a right chest rail connected to the right chest panel in proximity to the medial edge of the right chest panel and a left chest rail connected to the left chest panel in proximity to the medial edge of the left chest panel, the right chest fastening element of the chest fastener slidably mounted to the right chest rail and the left chest fastening element of the chest fastener slidably mounted to the left chest rail, the position of the chest fastener adjusted by sliding the right chest fastening element along the right chest rail and sliding the left chest fastening element along the left chest rail.

In some embodiments, the garment further includes a right abdomen rail connected to the right abdomen panel in proximity to the medial edge of the right abdomen panel and a left abdomen rail connected to the left abdomen panel in proximity to the medial edge of the left abdomen panel, the right abdomen fastening element of the abdomen fastener slidably mounted to the right abdomen rail and the left abdomen fastening element of the abdomen fastener slidably mounted to the left abdomen rail, the position of the abdomen fastener adjusted by sliding the right abdomen fastening element along the right abdomen rail and sliding the left abdomen fastening element along the left abdomen rail.

In some embodiments, the garment further includes at least one of a right side adjuster having a first part connected to a lower portion of the right abdomen panel and a second part positioned on a lower portion of the back panel and a left side adjuster having a first part connected to a lower portion of the left abdomen panel and a second part positioned on the lower portion of the back panel, the right and the left side adjusters being configured to fit the front and back portions.

In some embodiments, the back panel comprises an outer panel and an inner panel, the outer and the inner panels connected to form a back pocket bag therein between with an access opening, the back pocket bag configured to store items.

In some embodiments, the back panel further includes at least one securing retainer to secure the items when positioned in the back pocket bag.

In some embodiments, the outer panel is a pocket panel connected to the inner panel to form the back pocket bag.

In some embodiments, the at least one securing retainer is coupled to the back inner panel and/or the back outer panel in proximity to the access opening.

In some embodiments, the inner panel includes an absorbent material.

In some embodiments, an outer surface of the outer panel includes a reflective material.

In some embodiments, the inner panel includes a mesh.

In some embodiments, the garment further includes one or more front pocket panels connected to at least one of the right chest panel, the left chest panel, the right abdomen panel, the left abdomen panel, each front pocket panel forming a front pocket bag and an entrance opening of the front pocket bag.

In some embodiments, an inner panel of the front pocket bag includes an absorbent material.

In some embodiments, an outer surface of the one or more front pocket panels includes a reflective material.

In some embodiments, an inner panel of the front pocket bag includes a mesh.

In some embodiments, the garment further includes a right side panel having a top side forming portion of the right arm opening, a bottom side forming portion of the torso opening, a first side connected to the lateral side of the right abdomen panel and a second side connected to a portion of the right lateral side of the back panel, and a left side panel having a top side forming portion of the left arm opening, a bottom side forming portion of the torso opening, a first side connected to the lateral side of the left abdomen panel and a second side connected to a portion of the left lateral side of the back panel.

In some embodiments, the garment further includes at least one of a right side pocket panel connected to the right side panel to form a right side pocket bag and a left side pocket panel connected to the left side panel to form a left side pocket bag.

In some embodiments, an inner panel of the right side pocket bag and/or the left side pocket bag includes an absorbent material.

In some embodiments, an outer surface of the right side pocket panel and/or the left side pocket panel includes a reflective material.

In some embodiments, an inner panel of the right side pocket bag and/or the left side pocket bag includes a mesh.

In some embodiments, the garment is a vest, a jacket, a shirt, a life-vest, a harness, or a coat.

In some embodiments, the garment is an athletic vest.

In some embodiments, the garment further includes a left sleeve and a right sleeve.

According to an aspect, there is provided a support garment including a body configured to cover at least portion of a torso of a wearer and having an outer surface and an inner surface, the inner surface facing the wearer torso. The body comprising a back portion having a back panel with a top side forming a portion of a neck opening, a bottom side forming a portion of a torso opening, a right lateral side and a left lateral side, and a front portion having at least one front panel with a top side forming a portion of a neck opening, a bottom side forming a portion of a torso opening, a right lateral side and a left lateral side. The right lateral sides of the front and back portions joined directly or indirectly forming a right arm opening. The left lateral sides of the front and back portions joined directly or indirectly forming a left arm opening. The support garment further including at least one pocket bag formed at least in the support garment, the at least one pocket bag having an access opening and configured to store at least one thermal regulating element.

In some embodiments, the support garment further includes at least one of a right side adjuster having a first part connected to a right lower portion of the front panel and a second part positioned on a right lower portion of the back panel and a left side adjuster having a first part connected to a left lower portion of the front panel and a second part positioned on the left lower portion of the back panel, the right and the left side adjusters being configured to fit the front and back panels.

In some embodiments, the at least one pocket bag is formed from an outer panel and an inner panel of the back panel, the outer and the inner panels connected to form the at least one pocket bag therein between with an access opening.

In some embodiments, the back panel further includes at least one securing retainer to secure the items when positioned in the at least one pocket bag.

In some embodiments, the at least one securing retainer is coupled to the back inner panel and/or the back outer panel in proximity to the access opening.

In some embodiments, an inner panel of the at least one pocket bag includes an absorbent material.

In some embodiments, an outer surface of the at least one pocket bag includes a reflective material.

In some embodiments, an inner panel of the at least one pocket bag comprises a mesh.

In some embodiments, the support garment further includes a right side panel having a top side forming portion of the right arm opening, a bottom side forming portion of the torso opening, a first side connected to the right lateral side of the front panel and a second side connected to the right lateral side of the back panel, and a left side panel having a top side forming portion of the left arm opening, a bottom side forming portion of the torso opening, a first side connected to the left lateral side of the front panel and a second side connected to a portion of the left lateral side of the back panel.

In some embodiments, the support garment further includes at least one of a right side pocket panel connected to the right side panel to form the at least one pocket bag and a left side pocket panel connected to the left side panel to form the at least one pocket bag.

In some embodiments, the garment is a vest, a jacket, a shirt, a life-vest, a harness, or a coat.

In some embodiments, the garment is an athletic vest.

In some embodiments, the garment further includes a left sleeve and a right sleeve.

Many further features and combinations thereof concerning embodiments described herein will appear to those skilled in the art following a reading of the instant disclosure.

DESCRIPTION OF THE FIGURES

In the figures.

DETAILED DESCRIPTION

Figure 1B:
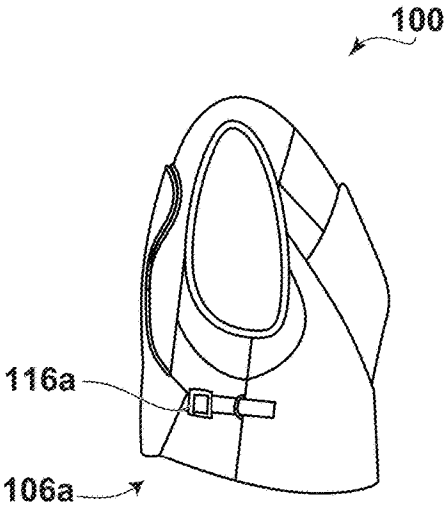
FIG. 1B illustrates a side view of an athletic vest in a closed configuration with two attachment points, according to some embodiments.

Garments worn during exercise or other activities may require enhanced support requirements. For example, an article of clothing may bump or jostle in uncomfortable or unhelpful ways while running or while engaged in active movement. Furthermore, where storage or carriage of items (e.g., personal items, food, water, cooling features, heating features, etc.) is intended during activity, particularly during high levels of activity, then proper fit may be even more paramount in order for the wearer to maintain proper balance. For example, in high risk activities it may be even more vital that garments, such as life-vests, bungee harnesses, harnesses, long-distance running equipment, rock-climbing equipment, parachutes or other safety/precautionary equipment, be properly fitted to the body type of the user.

Compounding to this problem of proper fit, current industry practice for clothing design and manufacturing targets a narrow range of the most common body types to minimize costs. However, given the wide range of body types present in the modern population, many individuals face challenges finding garments that properly fit. In particular, different body types have different requirements and needs for proper fit and support, which oftentimes cannot be met by simply resizing or altering existing clothing. Furthermore, in the case of athletic garments, they are often designed with a predominantly male customer base in mind, despite the fact that there is demand from all genders. Even when garments are designed for a particular body type (e.g., for women or for a non-industry standard body type) they are typically manufactured as a simple modified (i.e., smaller) version of the standard design without taking into account the unique fitting needs or the different body proportions of the particular body type. As such, garments such as athletic garments with improved fit are needed, including garments with adjustability options to accommodate a wide range of body types and variations while also minimizing cost of production.

Described herein are garments that include a front portion made up of four panels which offer attachment points generally across the user's chest and the user's abdomen. Such garments may be configured to adjust along the chest and abdomen of the user to accommodate a greater variety of body types. Such garments may be configured to fit more securely or comfortably on a user (e.g., during activities or for safety devices).

Though the following discussion focuses on embodiments using an athletic vest (e.g., a running vest), the Skilled Person will understand that the concepts described herein may also be applied to other garments. Of particular applicability, are garments used for activities or exercises where comfort and support may be important or garments used to protect the wearer where comfort and a secure fit may be important.

Four Panel Garments

First Embodiment—Two Attachment Points

The following is a general description of an example embodiment employing some of the concepts described herein. The Skilled Person would understand that the details of the following embodiment may be applied to other embodiments while still keeping with the teachings of this description.

Figure 1D:
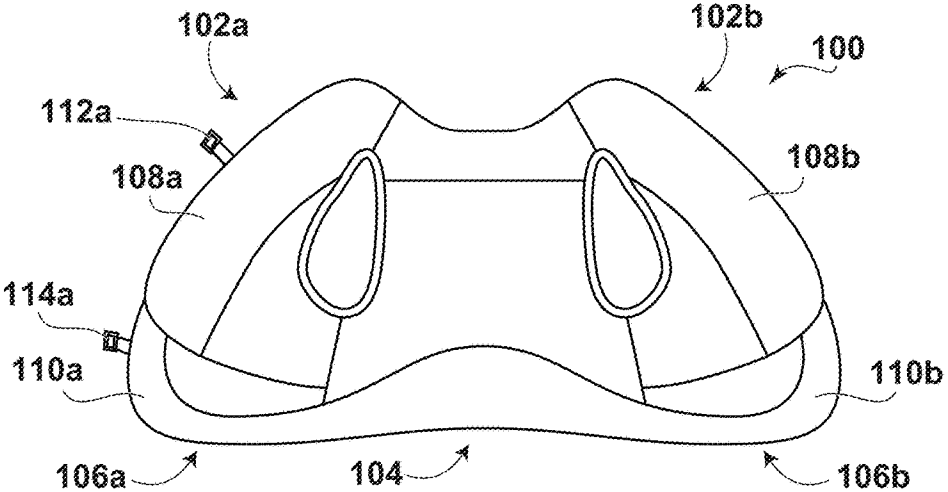
FIG. 1D illustrates a front view of an athletic vest in an opened configuration with two attachment points, according to some embodiments.
Figure 1A:
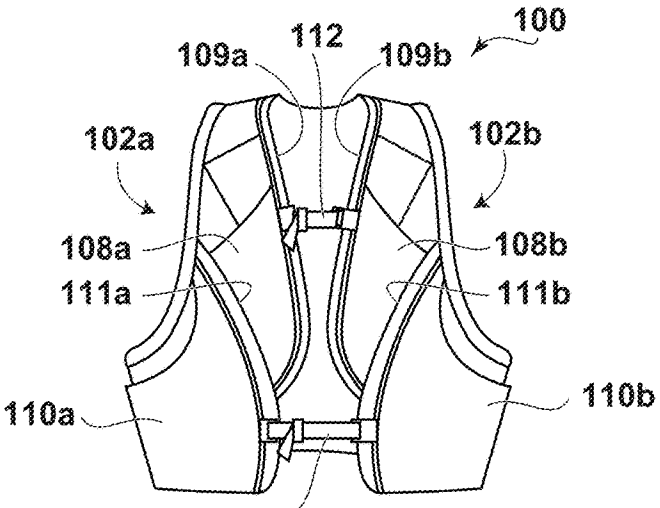
FIG. 1A illustrates a front view of an athletic vest in a closed configuration with two attachment points, according to some embodiments.

FIG. 1A illustrates a front view of an athletic vest 100 in a closed configuration with two attachment points 112 and 114, according to some embodiments.

The athletic vest 100 may comprise a front portion that may be divided into, for example, a front right portion 102*a* and a front left portion 102*b*. The front right portion 102*a* includes a right chest panel 108*a* and a right abdomen panel 110*a*. The front left portion 102*b* includes a left chest panel 108*b* and a left abdomen panel 110*b*. The chest panels 108*a* and 108*b* can be configured to cover at least a portion of the user's chest. The abdomen panels 110*a* and 110*b* can be configured to cover at least a portion of the user's abdomen.

The right chest panel 108*a* and the left chest panel 108*b* may be connected by, for example, a chest fastener 112. In some embodiments, the chest fastener 112 may be configured to permanently affix the right chest panel 108*a* and left chest panel 108*b* (e.g., in embodiments in which a user pulls the garment over their head) or may selectively couple the right chest panel 108*a* and left chest panel 108*b* (e.g., to open and permit the user to don the garment). The chest fastener 112 may be made up of chest fastening element 112*a* (see FIG. 1D) to couple with another fastening element. The chest fastener 112 may be adjustably positioned (discussed in greater detail below) or it may be permanently positioned on the garment. The chest fastener 112 can be tightened by the user to fasten the right chest panel 108*a* and left chest panel 108*b* together in a comfortable and secure arrangement. The fastener 112 can be configured to secure an upper portion of the user's chest in a comfortable and secure configuration. By being adjustable, the fastener 112 can accommodate users of differing chest sizes.

The right abdomen panel 110*a* and the left abdomen panel 110*b* may be connected by, for example, an abdomen fastener 114. The abdomen fastener 114 may generally be configured similarly to the chest fastener 112 described above, particularly with regards to permanent/selectable coupling, and position adjustability. The abdomen fastener 114 may be made up of abdomen fastening element 114*a* (see FIG. 1D) to couple with another fastening element. The abdomen fastener 114 can be tightened by the user to fasten the right abdomen panel 108*a* and left abdomen panel 108*b* together in a comfortable and secure arrangement. The fastener 112 can be configured to secure a portion of the user's abdomen (e.g., around the waist) in a comfortable and secure configuration. By being adjustable, the fastener 112 can accommodate users of differing waist sizes.

The chest fastener 112 and the abdomen fastener 114 can interoperate to comfortably secure the athletic vest 100 to a user regardless of their chest and waist sizes. The chest fastener 112 can secure the right chest panel 108*a* and the left chest panel 108*b* to the user. The abdomen fastener 114 can then secure the right abdomen panel 110*a* and left abdomen panel 110*b* to the user. The right abdomen panel 110*a* can overlap or otherwise overlay the right chest panel 108*a* and the left abdomen panel 110*b* can overlap or otherwise overlay the left chest panel 108*b*. This can secure the bottom portion of the chest panels 108*a* and 108*b* to the user in a way that still leaves room for the user's chest. The at least partial separation of the chest panels 108*a* and 108*b* from the abdomen panels 110*a* and 110*b* can enable to the front portions 102*a* and 102*b* to securely fit on the user's chest and abdomen without material build up in the regions between the chest fastener 112 and abdomen fastener 114 or having too little material to position the fasteners 112 and 114 properly on the user's body. In particular, the overlapping region may enable the different regions of the athletic vest 100 to move with the user while they move. Furthermore, the at least partial separation of the chest panels 108*a* and 108*b* from the abdomen panels 110*a* and 110*b* can allow the athletic vest 100 to be properly secured to the user without assumptions about chest and waist sizes enabling the athletic vest 100 to accommodate a greater variety of body types. Such features may provide the user with better fit and better comfort as the athletic vest 100 will not be substantially pushing down or otherwise restraining the user's chest. This fit may further be advantageous if pockets are installed in one or more of the chest panels 108*a* and 108*b* and abdomen panels 110*a* and 110*b*.

In some embodiments, the chest panels 108*a* and 108*b* may instead overlay the abdomen panels 110*a* and 110*b* rather than the abdomen panels 110*a* and 110*b* overlaying the chest panels 108*a* and 108*b*.

In some embodiments, the fasteners 112 and 114 can include, for example, hook and loop mechanisms, laces, buttons, zippers, cords, and combinations of same.

FIG. 1B illustrates a side view of an athletic vest 100 in a closed configuration with two attachment points 112 and 114, according to some embodiments.

Figure 1C:
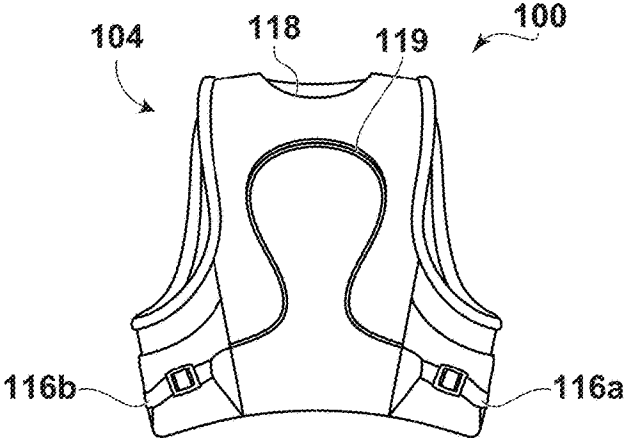
FIG. 1C illustrates a rear view of an athletic vest in a closed configuration with two attachment points, according to some embodiments.

The athletic vest 100 may optionally be made up of side portions 106*a* and 106*b* (see FIG. 1C). The side portion 106*a* may include a side adjustor 116*a*. The side adjustor 116*a* can provide a further option to adjust the sizing of the athletic vest 100. The side adjustor 116*a* can be adjusted to tighten/narrow or loosen/broaden the waist sizing of the athletic vest 100. This may further accommodate users with different waist proportions (e.g., to accommodate user's with wide, but shallow waists (i.e., wide along the frontal axis and narrow along the sagittal axis) or narrow, but deep waists (i.e., narrow along the frontal axis and wide along the sagittal axis)). The side adjustor 116*b* may function similarly to side adjustor 116*a*.

In some embodiments, the side portions 106*a* and 106*b* may be omitted. In such embodiments, the front portions 102*a* and 102*b* may connect directly with the back portion 104. Such embodiments may be simpler and more affordable to design and manufacture. Further, other features, such as the configuration of the chest panels 108*a* and 108*b* and the abdomen panels 110*a* and 110*b* may provide comfort and support. In such embodiments, there would also be no side adjustor 116*a*, though similar features may optionally be implemented (e.g., adjustors in the front portions 102*a* and 102*b* or the back portion 104).

FIG. 1C illustrates a rear view of an athletic vest 100 in a closed configuration with two attachment points 112 and 114, according to some embodiments.

The athletic vest 100 may include a back portion 104. The back portion 104 may include a first back pocket bag 118 and a second back pocket bag 119. The first back pocket bag 118 may have an opening just behind the neck hole. In some embodiments, the first back pocket bag 118 may be formed by an opening of between an inner panel and an outer panel. The inner panel and outer panel may be made of the same material or different materials. These panels may be designed based on the items to be put into the first back pocket bag 118 (e.g., mesh or absorbent inner panels and reflective outer panels if to accommodate ice for cooling). In some embodiments, the first back pocket bag 118 is formed by connecting a pocket panel to the back panel. In some embodiments, the back portion 104 of the athletic vest 100 may be made of, for example, a mesh, and first back pocket bag 118 may be stitched therein. In some embodiments, the first back pocket bag 118 may be formed in the athletic vest 100. The second back pocket bag 119 may have a zipper or other resealable opening elsewhere along the back portion 104 (e.g., further from the neck hole). The second back pocket bag 119 may be configured in a similar manner as described for the first back pocket bag 118. The second back pocket bag 119 may or may not overlap with the first back pocket bag 118. The second back pocket bag 119 may also be designed for specific functions. Some embodiments of the athletic vest 100 may be missing one or both back pocket bags 118 and 119. All back pocket bags 118 and 119 may provide a clean finish of the edges of the athletic vest 100 (e.g., stitched up on top).

In some embodiments, these back pocket bags 118 and 119 may be configured to receive items (e.g., snacks or personal belongings) and securely store them while the user is moving. The athletic vest 100 may be configured to keep the placement of these items generally secure and without movement while used. For example, by properly securing the chest fastener 112 and abdomen fastener 114 the back pocket bags 118 and 119 may be secured in a manner that effectively diminishes the items' inertia as they the user moves which may reduce the degree to which the athletic vest 100 pops up and down during movement (e.g., during running).

In some embodiments, the back pocket bags 118 and 119 may be configured with items which provide specialized features to the athletic vest 100. An example of such an item can include heating or cooling implements (heating elements, ice, cooling elements, etc.). The athletic vest 100 may be specially configured to hold such items such as through the inclusion of reflective layers and absorbent materials for ice (as described in greater detail below). Another example of such an item can include a hydration pack. The athletic vest 100 may be designed with specific straw openings (as described in greater detail below).

FIG. 1D illustrates a front view of an athletic vest 100 in an opened configuration with two attachment points 112 and 114, according to some embodiments.

This figure illustrates the bottom portion of the right chest panel 108*a* and left chest panel 108*b* which was obscured in FIG. 1A. The overlapping region can enable the chest panels 108*a* and 108*b* to be secured against the user's body while leaving room for the user's chest. The abdomen panels 110*a* and 110*b* can hold the bottom edges of the chest panels 108*a* and 108*b* secure to prevent flapping or unwanted movement of the chest panels 108*a* and 108*b*. In some embodiments, the chest panels 108*a* and 108*b* and the abdomen panels 110*a* and 110*b* are not connected at all. In some embodiments, the chest panels 108*a* and 108*b* and the abdomen panels 110*a* and 110*b* are connected/secured to one to another only at single point (e.g., not along the entire bottom edge of the chest panels 108*a* and 108*b*) at, for example, an overlapping corner. Such embodiments may prevent the abdomen panels 110*a* and 110*b* from flapping freely while in use, for example, if not fastened. In some embodiments, the athletic vest 100 may be openable for the user (e.g., the right front portion 102*a* may come away from 102*b* to accommodate the user rather than being designed as a pullover).

Second Embodiment—Three Attachment Points

The following is a general description of another example embodiment employing some of the concepts described herein. In particular, the following embodiment describes differing fastener configurations and an embodiment without a side adjustor. The Skilled Person would understand that the details of the following embodiment may be applied to other embodiments while still keeping with the teachings of this description.

Figure 2B:
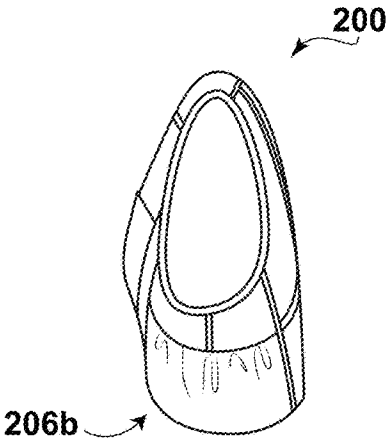
FIG. 2B illustrates a side view of an athletic vest in a closed configuration with three attachment points, according to some embodiments.
Figure 2A:
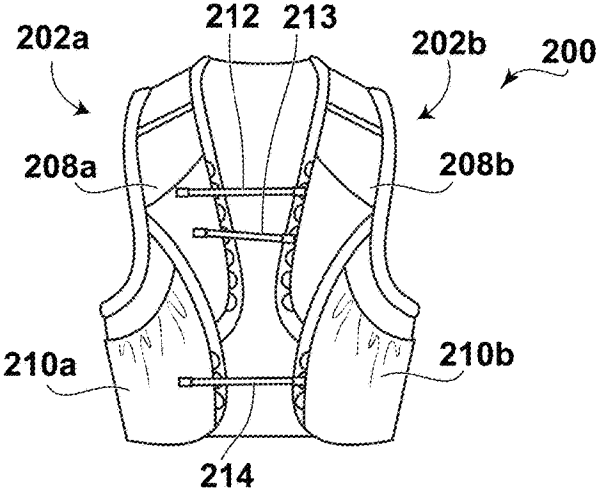
FIG. 2A illustrates a front view of an athletic vest in a closed configuration with three attachment points, according to some embodiments.

FIG. 2A illustrates a front view of an athletic vest 200 in a closed configuration with three attachment points 212, 213, and 214, according to some embodiments.

FIG. 2B illustrates a side view of an athletic vest 200 in a closed configuration with three attachment points 212, 213, and 214, according to some embodiments.

Figure 2D:
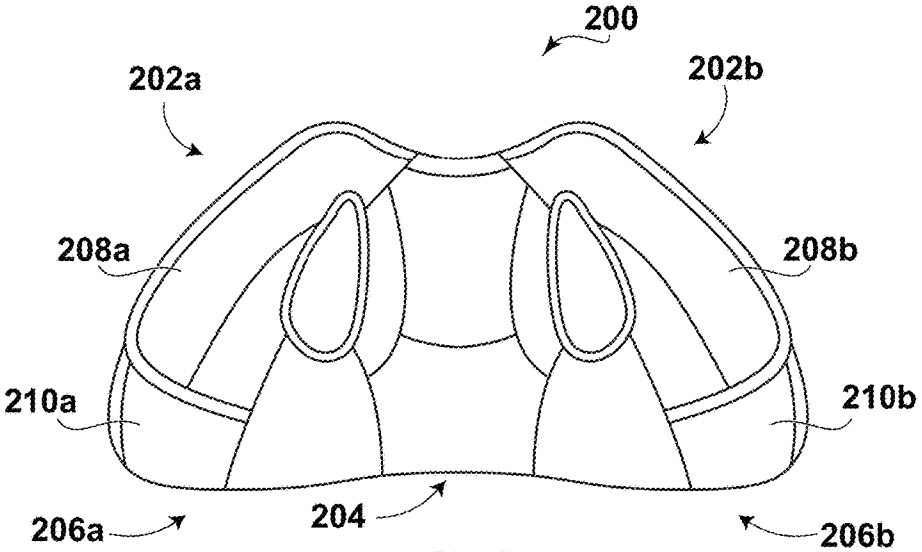
FIG. 2D illustrates a front view of an athletic vest in an opened configuration with three attachment points, according to some embodiments.
Figure 2C:
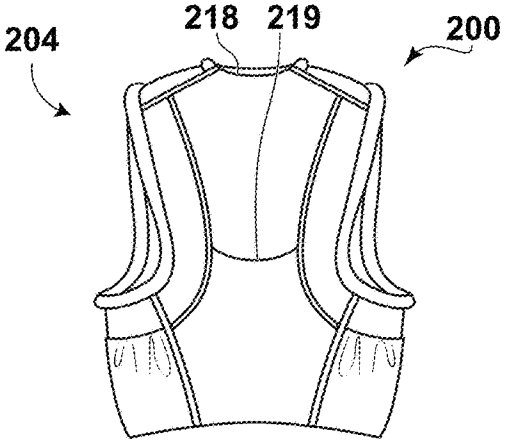
FIG. 2C illustrates a rear view of an athletic vest in a closed configuration with three attachment points, according to some embodiments.

FIG. 2C illustrates a rear view of an athletic vest 200 in a closed configuration with three attachment points 212, 213, and 214, according to some embodiments.

FIG. 2D illustrates a front view of an athletic vest 200 in an opened configuration with three attachment points 212, 213, and 214, according to some embodiments.

The athletic vest 200 may include a front portion, side portions 206*a* and 206*b*, and a back portion 204. The front portion may include a front right portion 202*a* and a front left portion 202*b*. These front portions may be made up of a right chest panel 208*a* or a left chest panel 208*b* and a right abdomen panel 210*a* or a left abdomen panel 210*b*. The chest panels 208*a* and 208*b* may be connectable by a chest fastener 212 and optionally a second chest fastener 213. The abdomen panels 210*a* and 210*b* may be connectable by an abdomen fastener 214. The back portion 204 may optionally include a first back pocket bag 218 and a second back pocket bag 219. The components of the athletic vest 200 generally have similar features, properties, variations, and modifications as were described for similar components in the athletic vest 100 of FIG. 1A-1D or otherwise described herein.

Referring to FIG. 2A, the athletic vest 200 includes a second chest fastener 213. The additional chest fastener 213 can provide an additional attachment point between the right chest panel 202*a* and the left chest panel 202*b*. This additional attachment may more properly secure the athletic vest 200 to the user. The requirement of a second chest fastener 213 (or indeed more) may depend on a variety of factors such as the level of security wanted (e.g., more attachment points may provide redundancies for, for example, life-vest attachment points), the material with which the athletic vest 200 is made (e.g., thinner or looser materials may require a greater number of attachment points to be secured while thicker materials may not), or other considerations. In some embodiments, the second chest fastener 213 may be configured to separately attach between the right chest panel 208*a* and the left chest panel 208*b*. In some embodiments, the second chest fastener 213 may be configured to overlap with the chest fastener 212 (e.g., in an "X" pattern across the region between right chest panel 202*a* and left chest panel 202*b*). In some embodiments, there may be more additional chest fasteners (not shown) beyond chest fastener 212 and second chest fastener 213.

In some embodiments, the athletic vest 200 may have additional abdomen fasteners (not shown) which may separately attach between the right abdomen panel 210*a* and the left abdomen panel 210*b* or may overlap with the abdomen fastener 214 similarly as described above with regards to the second chest fastener 213. In some embodiments, there may be more than one additional abdomen fastener.

Referring to FIG. 2B, the athletic vest 200 shows an example of a vest without side adjustors. Some embodiments, may not require side adjustors to secure the athletic vest 200 to the user. For example, some materials may be thinner and may easily conform to the user's shape irrespective of proportions along the frontal and sagittal axes. In some embodiments, the athletic vest 200 may be equipped with additional abdomen fasteners (not shown) to secure the athletic vest 200 to the user.

Third Embodiment—Two Attachment Points and Back Pocket

The following is a general description of another example embodiment employing some of the concepts described herein. In particular, the following embodiment illustrates an abdomen panel pulled away from the chest panel to highlight the overlapping region. The Skilled Person would understand that the details of the following embodiment may be applied to other embodiments while still keeping with the teachings of this description.

Figure 3B:
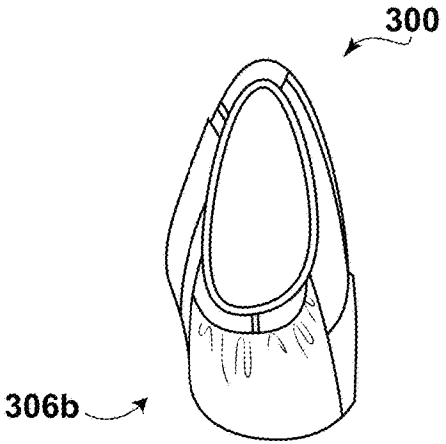
FIG. 3B illustrates a side view of an athletic vest in a closed configuration with two attachment points, according to some embodiments.
Figure 3A:
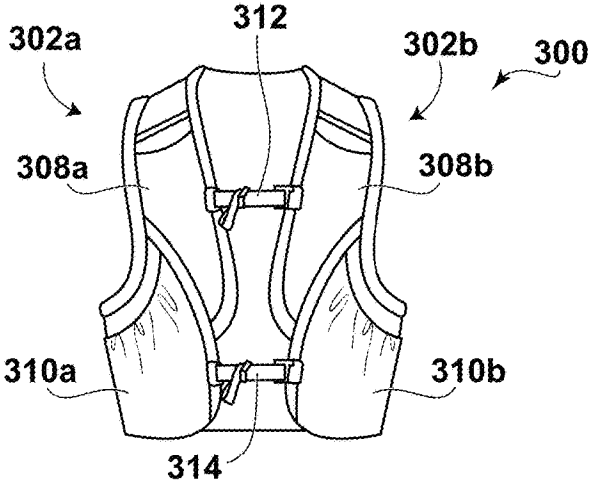
FIG. 3A illustrates a front view of an athletic vest in a closed configuration with two attachment points, according to some embodiments.

FIG. 3A illustrates a front view of another athletic vest 300 in a generally closed configuration with two attachment points 312 and 314, according to some embodiments.

FIG. 3B illustrates a rear view of another athletic vest 300 in a generally closed configuration with two attachment points 312 and 314, according to some embodiments.

Figure 3D:
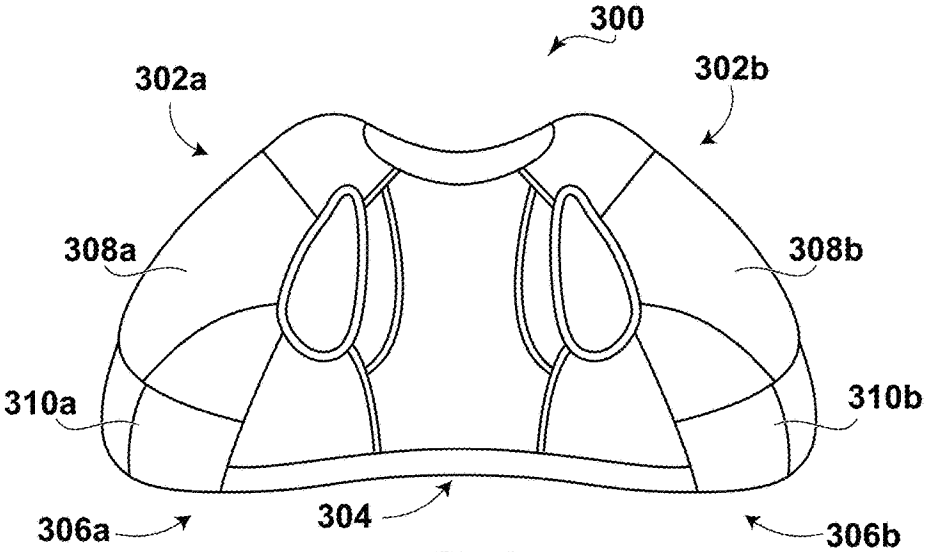
FIG. 3D illustrates a front view of an athletic vest in an opened configuration with two attachment points, according to some embodiments.
Figure 3C:
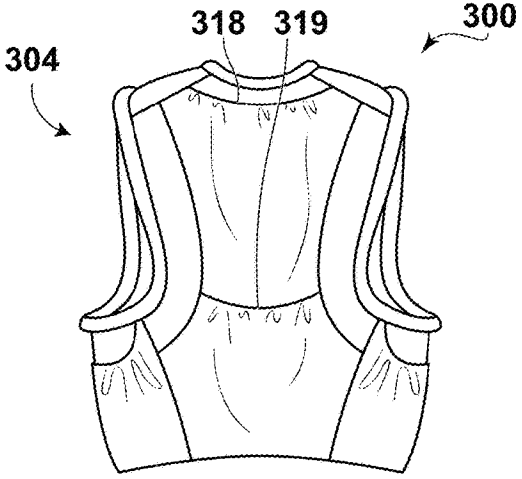
FIG. 3C illustrates a rear view of an athletic vest in a closed configuration with two attachment points, according to some embodiments.

FIG. 3C illustrates a front view of another athletic vest 300 in a partially opened configuration with two attachment points 312 and 314, according to some embodiments.

FIG. 3D illustrates a front view of another athletic vest 300 in an opened configuration with two attachment points 312 and 314, according to some embodiments.

The athletic vest 300 may include a front portion and a back portion 304. The front portion may include a front right portion 302*a* and a front left portion 302*b*. These front portions may be made up of a right chest panel 308*a* or a left chest panel 308*b* and a right abdomen panel 310*a* or a left abdomen panel 310*b*. The chest panels 308*a* and 308*b* may be connected by a chest fastener 312. The abdomen panels 310*a* and 310*b* may be connected by an abdomen fastener 314. The components of the athletic vest 300 generally have similar features, properties, variations, and modifications as were described for similar components in the athletic vests 100 and 200 of FIG. 1 and FIG. 2 respectively or otherwise described herein.

Referring to FIG. 3C, the back portion 304 may optionally include a first back pocket bag 318 and a second back pocket bag 319. These pockets may be used to secure items. Some of those items may be snacks, water bottles, or other personal belongings. In some embodiments the pockets may be configured to hold other items such as heating or cooling features.

Fourth Embodiment—Region Between Chest and Abdomen Panels

The following is a general description of another example embodiment employing some of the concepts described herein. In particular, the following embodiment illustrates an abdomen panel pulled away from the chest panel to highlight the overlapping region. The Skilled Person would understand that the details of the following embodiment may be applied to other embodiments while still keeping with the teachings of this description.

Figure 4B:
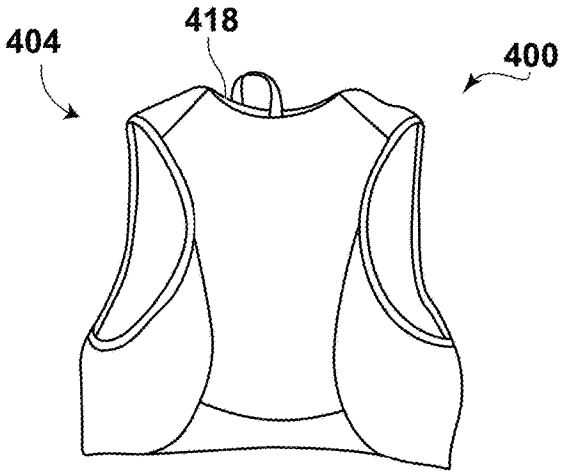
FIG. 4B illustrates a rear view of another athletic vest in a generally closed configuration with two attachment points, according to some embodiments.
Figure 4A:
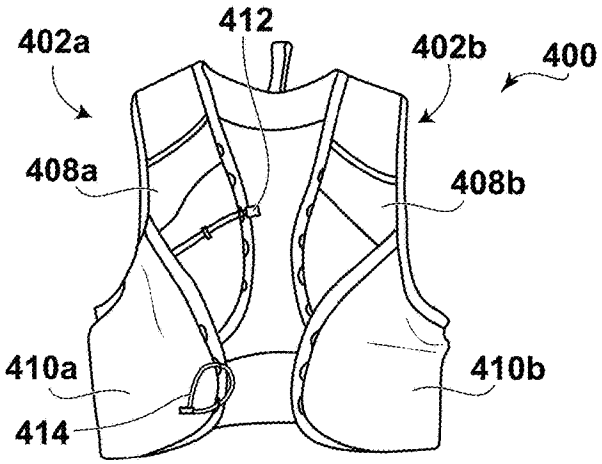
FIG. 4A illustrates a front view of another athletic vest in a generally closed configuration with two attachment points, according to some embodiments.

FIG. 4A illustrates a front view of another athletic vest 400 in a generally closed configuration with two attachment points 412 and 414, according to some embodiments.

FIG. 4B illustrates a rear view of another athletic vest 400 in a generally closed configuration with two attachment points 412 and 414, according to some embodiments.

Figure 4D:
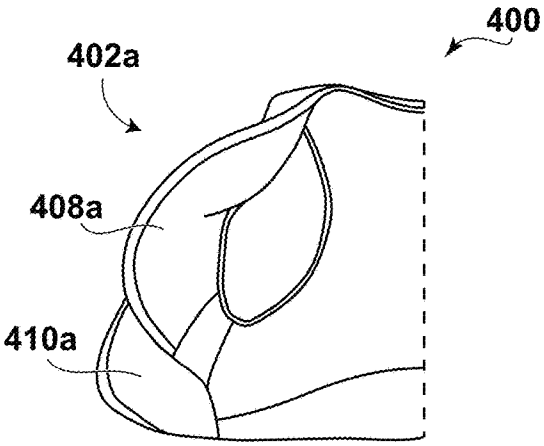
FIG. 4D illustrates a front view of another athletic vest in an opened configuration with two attachment points, according to some embodiments.
Figure 4C:
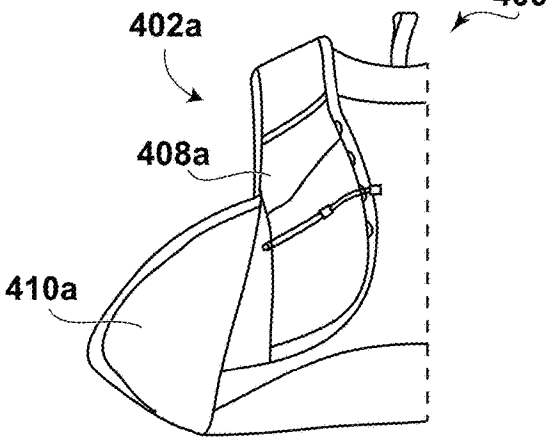
FIG. 4C illustrates a front view of another athletic vest in a partially opened configuration with two attachment points, according to some embodiments.

FIG. 4C illustrates a front view of another athletic vest 400 in a partially opened configuration with two attachment points 412 and 414, according to some embodiments.

FIG. 4D illustrates a front view of another athletic vest 400 in an opened configuration with two attachment points 412 and 414, according to some embodiments.

The athletic vest 400 may include a front portion and a back portion 404. The front portion may include a front right portion 402*a* and a front left portion 402*b*. These front portions may be made up of a right chest panel 408*a* or a left chest panel 408*b* and a right abdomen panel 410*a* or a left abdomen panel 410*b*. The chest panels 408*a* and 408*b* may be connected by a chest fastener 412. The abdomen panels 410*a* and 410*b* may be connected by an abdomen fastener 414. The components of the athletic vest 400 generally have similar features, properties, variations, and modifications as were described for similar components in the athletic vests 100, 200, and 300 of FIG. 1A-1D, FIG. 2A-2D, and FIG. 3A-3D respectively or otherwise described herein.

Referring to FIG. 4C, the right abdomen panel 410*a* has been pulled away from the right chest panel 408*a*. The region of these panels 408*a* and 410*a* which overlays enables the right abdomen pane 410*a* to hold a bottom region of the right chest panel 408*a* in place when worn by a user. This can enable the garment to separate to accommodate users of different chest sizes. In some embodiments, the right chest panel 408*a* and the right abdomen panel 410*a* are separate from one another. In some embodiments, the right chest panel 408*a* and the right abdomen panel 410*a* are partially connected to one another (e.g., to ensure proper positioning when worn by the user). In some embodiments, the right chest panel 408*a* and the right abdomen panel 410*a* may be selectively connected (e.g., by a hook and loop mechanism). In some embodiments, these features may be mirrored or otherwise adapted to the left front portion 402*b* as between the left chest panel 408*b* and the left abdomen panel 410*b*. Using a selective connection system, the athletic vest 400 may be further securely positioned when worn by a user.

In some embodiments, one or more of the right chest panel 408*a*, the left chest panel 408*b*, the right abdomen panel 410*a*, and the left abdomen panel 410*b* may be made up of one or more panels. Such embodiments may offer further accommodation for the user or may better move with the user while in use.

In some embodiments, the shapes of the chest panels 408*a* and 408*b* and the abdomen panels 410*a* and 410*b* may be configured to shape to the user. For example, these panels may be configured to attach to the rest of the athletic vest 400 in a manner intended to curve the sides of the athletic vest 400 providing three dimensionality to the design. In some embodiments, these panels are shaped to accommodate the dynamic shape of the torso of the user (e.g., rounded). In some embodiments, the hem may be adapted to suit different body types. In some embodiments, the lateral sides of the panels are contoured to achieved curvature through the stitch line to build a curved seam into the athletic vest 400.

Fifth Embodiment—Fit on a User

The following is a general description of another example embodiment employing some of the concepts described herein. In particular, the following embodiment illustrates the fit of embodiments of the described subject matter on a user. The Skilled Person would understand that the details of the following embodiment may be applied to other embodiments while still keeping with the teachings of this description.

Figure 5C:
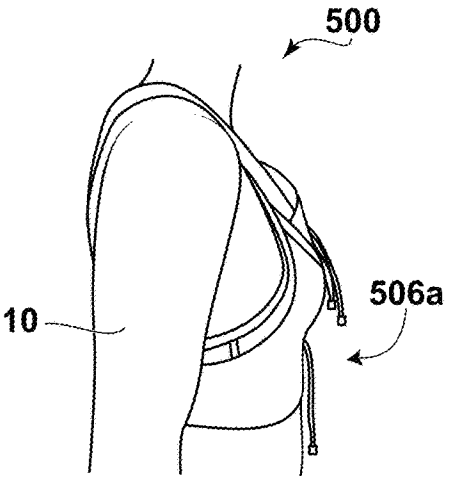
FIG. 5C illustrates a side view of an athletic vest with three attachment points worn by a user, according to some embodiments.
Figure 5B:
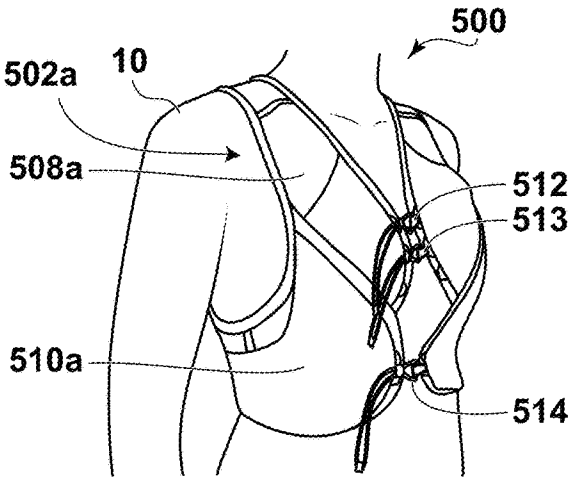
FIG. 5B illustrates a quarter turn view of an athletic vest with three attachment points worn by a user, according to some embodiments.
Figure 5A:
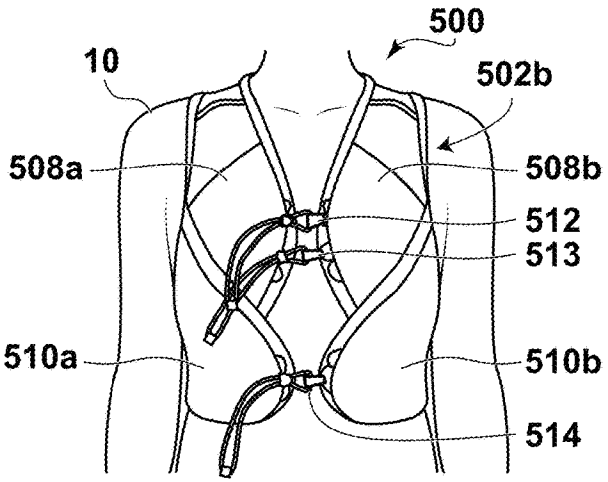
FIG. 5A illustrates a front view of an athletic vest with three attachment points worn by a user, according to some embodiments.

FIG. 5A illustrates a front view of an athletic vest 500 with three attachment points 512, 513, and 514 worn by a user 10, according to some embodiments.

FIG. 5B illustrates a quarter turn view of an athletic vest 500 with three attachment points 512, 513, and 514 worn by a user 10, according to some embodiments.

FIG. 5C illustrates a side view of an athletic vest 500 with three attachment points 512, 513, and 514 worn by a user 10, according to some embodiments.

Figure 5F:
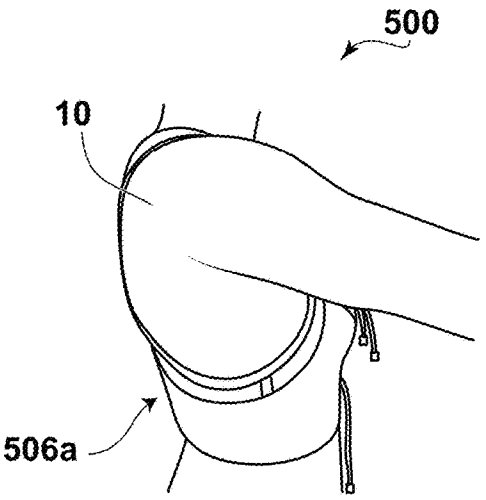
FIG. 5F illustrates a side view of an athletic vest with three attachment points worn by a user with their arms extended in front of the user, according to some embodiments.
Figure 5E:
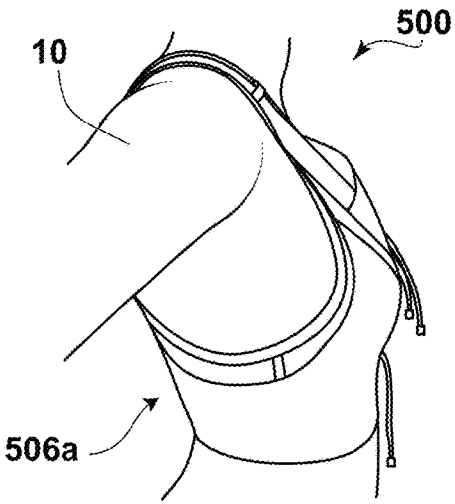
FIG. 5E illustrates a side view of an athletic vest worn with three attachment points by a user with their arms behind the user, according to some embodiments.
Figure 5D:
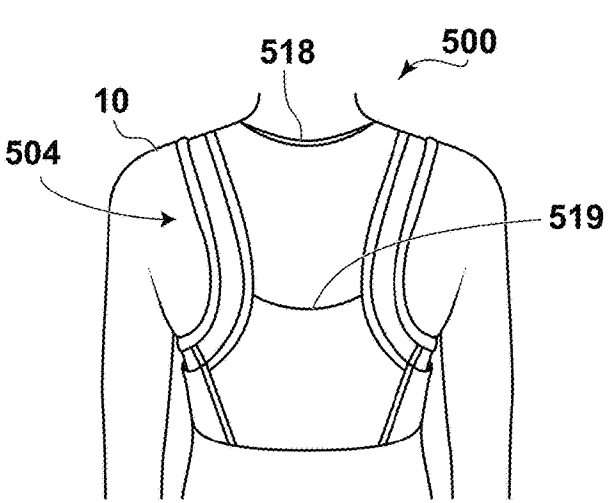
FIG. 5D illustrates a rear view of an athletic vest with three attachment points worn by a user, according to some embodiments.

FIG. 5D illustrates a rear view of an athletic vest 500 with three attachment points 512, 513, and 514 worn by a user 10, according to some embodiments.

FIG. 5E illustrates a side view of an athletic vest 500 with three attachment points 512, 513, and 514 worn by a user 10 with their arms behind them, according to some embodiments.

FIG. 5F illustrates a side view of an athletic vest 500 with three attachment points 512, 513, and 514 worn by a user 10 with their arms extended in front of them, according to some embodiments.

The athletic vest 500 may include a front portion, side portions 506*a*, and a back portion 504. The front portion may include a front right portion 502*a* and a front left portion 502*b*. These front portions may be made up of a right chest panel 508*a* or a left chest panel 508*b* and a right abdomen panel 510*a* or a left abdomen panel 510*b*. The chest panels 508*a* and 508*b* may be connected by a chest fastener 512 and second chest fastener 513. The abdomen panels 510*a* and 510*b* can may be connected by an abdomen fastener 514. The back portion 504 may contain a first back pocket bag 518 and a second back pocket bag 519. The components of the athletic vest 500 generally have similar features, properties, variations, and modifications as were described for similar components in the athletic vests 100, 200, 300, and 400 of FIG. 1A-1D, FIG. 2A-2D, FIG. 3A-3D, and FIG. 4A-4D respectively or otherwise described herein. The specific placement of the fasteners 512, 513, and 514 may vary depending on the embodiment.

As can be seen in the figures, the partial separation of the front portions 502*a* and 502*b* into the chest panels 508*a* and 508*b* and the abdomen panels 510*a* and 510*b* enables the athletic vest 500 to fit comfortable and securely on the user 10 while providing proper dimensions for the waist the chest proportions. The athletic vest 500 may also provide the user 10 with a wide range of motion with regards to their arms which may be advantageous for some activities such as running.

ADDITIONAL EMBODIMENTS

Figure 6A:
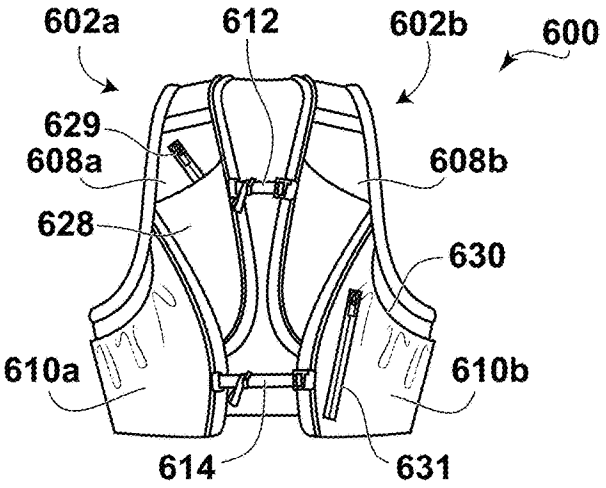
FIG. 6A, FIG. 6B, and FIG. 6C illustrate a front view, a side view, and a rear view of a further embodiment athletic vest respectively, according to some embodiments.
Figure 6B:
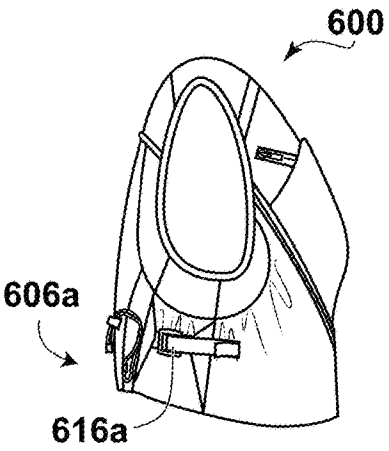
Figure 6C:
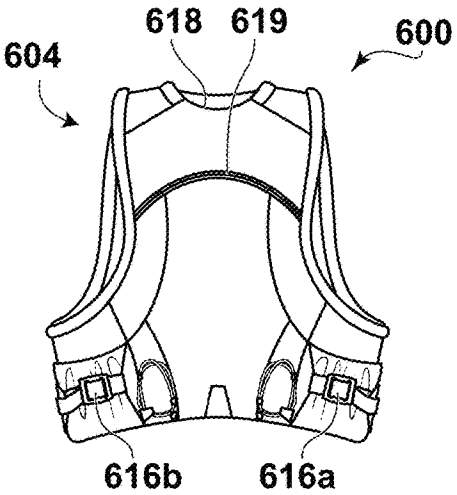

FIG. 6A, FIG. 6B, and FIG. 6C illustrate a front view, a side view, and a rear view of a further embodiment athletic vest 600 respectively, according to some embodiments.

The athletic vest 600 may include a front portion, optional side portions 606*a*, and a back portion 604. The front portion may include a front right portion 602*a* and a front left portion 602*b*. These front portions may be made up of a right chest panel 608*a* or a left chest panel 608*b* and a right abdomen panel 610*a* or a left abdomen panel 610*b*. The chest panels 608*a* and 608*b* may be connected by a chest fastener 612. The abdomen panels 610*a* and 610*b* can may be connected by an abdomen fastener 614. The optional side portion 606*a* may include a side adjustor 616*a*. The back portion 604 may contain a first back pocket bag 618 and a second back pocket bag 619. The components of the athletic vest 600 generally have similar features, properties, variations, and modifications as were described for similar components in the athletic vests 100, 200, 300, 400, and 500 of FIG. 1A-1D, FIG. 2A-2D, FIG. 3A-3D, FIG. 4A-4D, and FIG. 5A-5F respectively or otherwise described herein. The specific placement of the fasteners 612 and 614 may vary depending on the embodiment.

As can be seen in the above figures, additional pocket bags can be built into the components. For example, the right chest panel 608*a* has both a mesh pocket bag 628 and a zipper pocket 629 built into the right chest panel 608*a*. As a further example, the left abdomen panel 610*b* includes a pocket bag 630 and a zipper pocket 631 built into the pocket panel of the pocket bag 630.

Figure 7A:
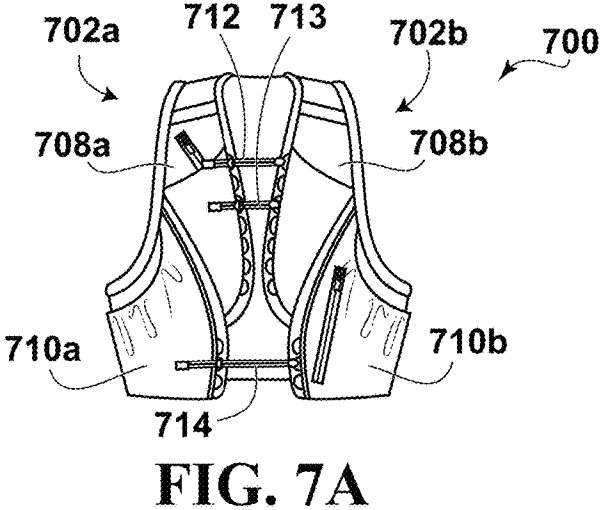
FIG. 7A, FIG. 7B, and FIG. 7C illustrate a front view, a side view, and a rear view of a further embodiment athletic vest respectively, according to some embodiments.
Figure 7B:
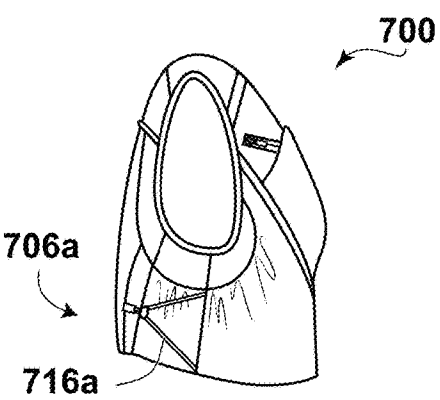
Figure 7C:
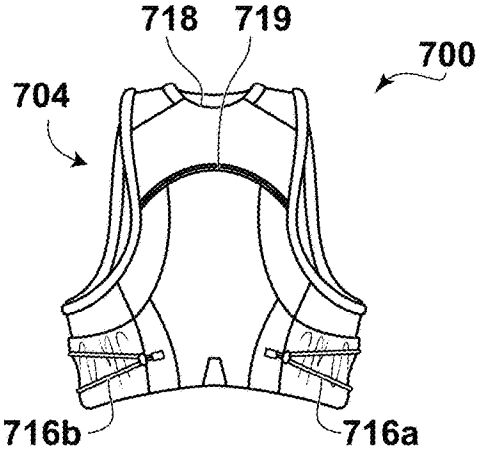

FIG. 7A, FIG. 7B, and FIG. 7C illustrate a front view, a side view, and a rear view of a further embodiment athletic vest 700 respectively, according to some embodiments.

The athletic vest 700 may include a front portion, optional side portions 706*a*, and a back portion 704. The front portion may include a front right portion 702*a* and a front left portion 702*b*. These front portions may be made up of a right chest panel 708*a* or a left chest panel 708*b* and a right abdomen panel 710*a* or a left abdomen panel 710*b*. The chest panels 708*a* and 708*b* may be connected by a chest fastener 712 and a second chest fastener 713. The abdomen panels 710*a* and 710*b* can may be connected by an abdomen fastener 714. The optional side portion 706*a* may include a side adjustor 716*a*. The back portion 704 may contain a first back pocket bag 718 and a second back pocket bag 719. The components of the athletic vest 700 generally have similar features, properties, variations, and modifications as were described for similar components in the athletic vests 100, 200, 300, 400, 500, and 600 FIG. 1A-1D, FIG. 2A-2D, FIG. 3A-3D, FIG. 4A-4D, FIG. 5A-5F, and FIG. 6A-6C respectively or otherwise described herein. The specific placement of the fasteners 712, 713, and 714 may vary depending on the embodiment.

As can be seen in the above figures, the side adjustors 716*a* and 716*b* are configured with elastic strings and keepers.

The Skilled Person would understand that many variations and combinations based on the features described herein are possible while still keeping with the teachings of this description.

Fasteners

The following provide some example variations on fasteners that may be used with embodiments of the subject matter described herein. The Skilled Person would understand that the details of the following embodiments may be applied to other embodiments while still keeping with the teachings of this description.

Figure 8B:
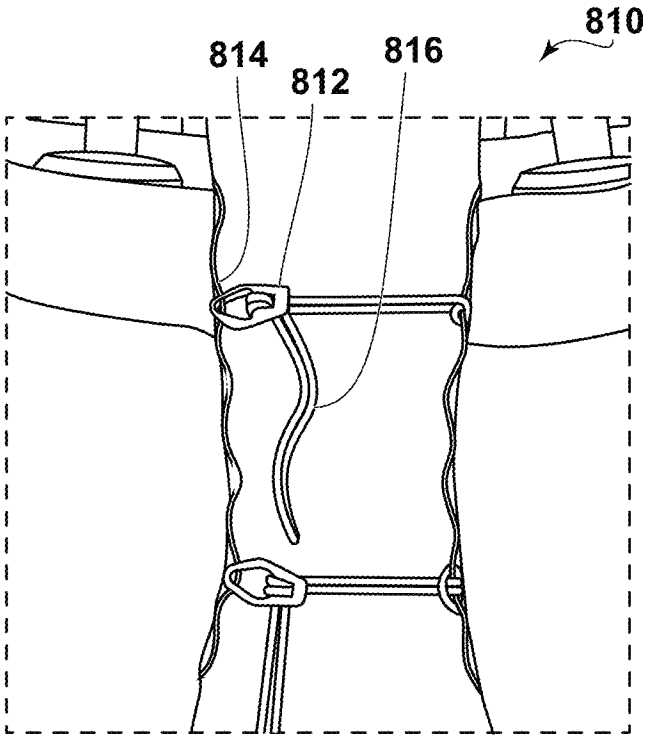
FIG. 8A and FIG. 8B each illustrate a front view of a fastener, according to some embodiments.
Figure 8A:
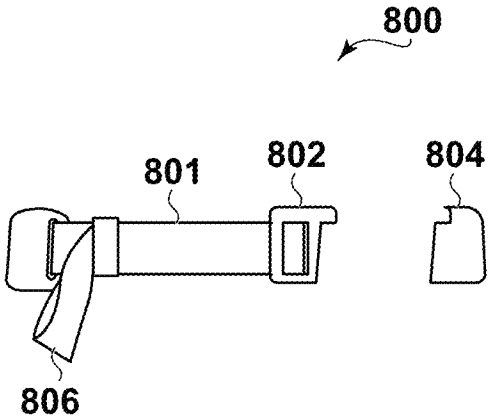

FIG. 8A and FIG. 8B each illustrate a front view of a fastener 800 and 810, according to some embodiments.

FIG. 8A illustrates an example fastener 800. The fastener 800 includes a strap 801 sewn to the vest at one and with a male component 802 attached to the other end. The male component 802 is configured to interoperate and couple to a female component 804. The strap 801 may be adjustable to adjust the fit and tension in the fastener 800. The strap 801 may be adjusted by manipulating the adjustor 806. Such a fastener 800 may be used as one or both of the chest fastener and the abdomen fastener. This fastener may also be suitable for other components of an embodiment athletic vest such as a side adjustor or other components not described.

FIG. 8B illustrates an example fastener 810. The fastener 810 includes a string component 812 configured to interoperate and couple with a loop closure 814. The loop closures 814 may be on one or both sides of the gap intended to be secured (e.g., on a right chest panel and on a left chest panel). Furthermore, some embodiments may include lines of loop closures 814 to offer the user options in where to secure the garment. The string component 812 may be configured to adjust the tension thereby adjusting the fit. This may be achieved by manipulating the adjustor 816. The string component 812 may be configured to tie around a loop closure 814 on one side of a gap and clip or hook on a loop closure 814 on the other side of the gap. Such a fastener 810 may be used as one or both of the chest fastener and the abdomen fastener. This fastener may also be suitable for other components of an embodiment athletic vest such as a side adjustor or other components not described.

Figure 9C:
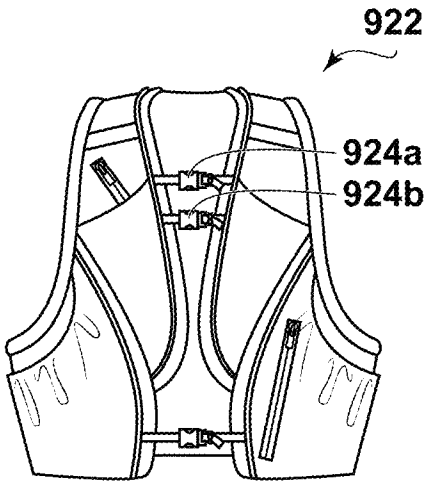
FIG. 9C illustrates a front view of an athletic vest with fixed fasteners, according to some embodiments.
Figure 9B:
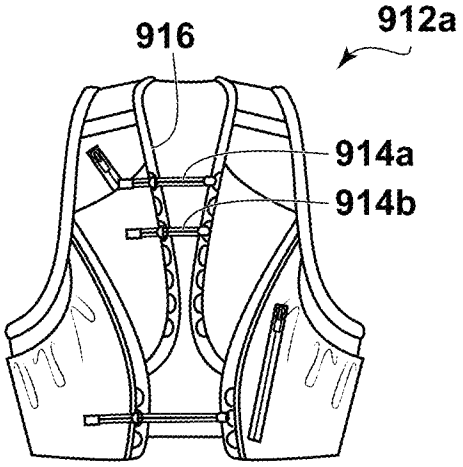
FIG. 9B illustrates a front view of an athletic vest with a plurality of loop closures 816 with fasteners fastened thereto, according to some embodiments.
Figure 9B:
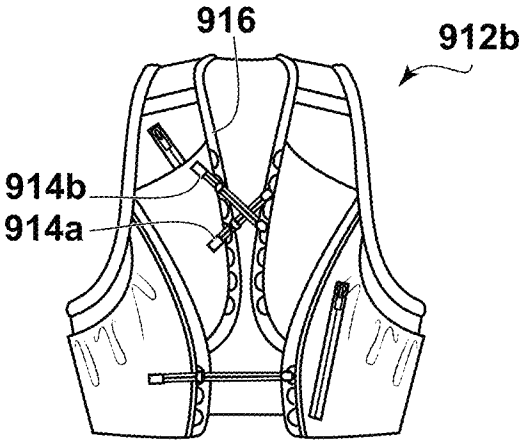
Figure 9A:
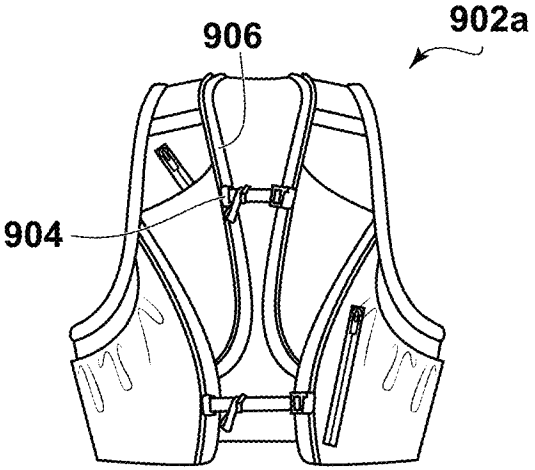
FIG. 9A illustrates a front view of an athletic vest with a rail with a fastener slideably mounted thereto, according to some embodiments.
Figure 9A:
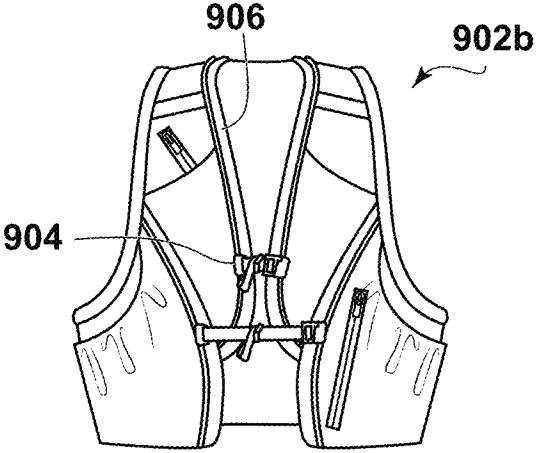

FIG. 9A illustrates a front view of an athletic vest 902 (inclusive of 902*a* and 902*b*) with a rail 906 with a fastener 904 slideably mounted thereto, according to some embodiments.

In some embodiments, the fastener 904 may be adjustably affixed to an athletic vest 902. For example, the fastener 904 may be configured to slide up and down a rail 906 proximate to an edge of the panels (e.g., chest panel and/or abdomen panel). The user may be able to slide the fastener up or down to the preferred position and then secure the fastener (see, for example, the position of the fastener 904 on athletic vest 902*a* and on athletic vest 902*b*). Such embodiments may provide the user with further adjustment options to better fit a garment to the user and accommodate a wider variety of body types and proportions.

FIG. 9B illustrates a front view of an athletic vest 912 (inclusive of 912*a* and 912*b*) with a plurality of loop closures 916 with fasteners 914*a* and 914*b* fastened thereto, according to some embodiments.

In some embodiments, the fasteners 914*a* and 914*b* may be adjustably affixed to different points along the athletic vest 912. For example, the fasteners 914*a* and 914*b* may be configured to attach to different loop closures along a plurality of loop closures 916 proximate to an edge of the panels (e.g., chest panel and/or abdomen panel). The user may be able to adjust the configuration of the fasteners 914*a* and 914*b* and, in particular, adjust the fasteners 914*a* and 914*b* relative to each other (see, for example, how the fasteners 914*a* and 914*b* are configured parallel to each other on athletic vest 912*a* and across each other on athletic vest 912*b*). Such embodiments may provide the user with further adjustment options to better fit a garment to the user and accommodate a wider variety of body types and proportions.

FIG. 9C illustrates a front view of an athletic vest 922 with fixed fasteners 924*a* and 924*b*, according to some embodiments.

In some embodiments, the fasteners 924*a* and 924*b* may be affixed to the athletic vest 922. For example, the fasteners 924*a* and 924*b* may be affixed to specific points proximate to an edge of the panels (e.g., chest panel and/or abdomen panel). The user may be able to adjust the length of the fasteners 924*a* and 924*b*, though the positioning may not be adjusted. Such embodiments may provide the user with optimal fastener positioning to obviate additional decisions made by the users.

The Skilled Person would understand that additional fastener options would be available. The Skilled Person would understand that any or all of the fastener options described above may be used on the same athletic vest (e.g., different fasteners may use different fastening styles). The Skilled Person would further understand that embodiments where the fasteners may be adjustable on one side, could equally be applied to the other side, or to both sides.

Additional Garment Details

In some embodiments, the athletic vest may include attachment points to affix light attachments (e.g., bike lights). Such attachments may be useful to increase the visibility of the wearer, for example, if using the vest in the dark particularly along a road.

In some embodiments, the athletic vest may be configured with a hiking pole cord holder tape attachment.

In some embodiments, the right and left chest panels can comprise a respective right and left cup part that encapsulates each of the wearer's breasts and provides damping support and/or compression for the wearer's breasts. In one embodiment, the cups can have a 3-D shape and can be formed by seaming, sewing, molding, knitting or any other suitable technique or combination thereof. In various embodiments, the chest panels can comprise reinforcing elements around the cups designed to support and/or reinforce the breast tissue. Each of the chest panels can include an outer liner and an inner liner that may be bonded, fused, or glued together. The reinforcing structure can be bonded, fused or glued therein between to provide a support along the root of the breast tissue. In various embodiments, a pocket can be formed between the inner and outer liner of the chest panels so that molded breast inset can be insertable into a respective pocket to provide breast support.

Referring to FIG. 1A to FIG. 1D, according to an aspect, there is provided a support garment 100 including a body configured to cover at least a portion of a torso of a wearer and having an outer surface and an inner surface, the inner surface facing the wearer torso. The body including a back portion 104 having a back panel with a top side forming a portion of a neck opening, a bottom side forming a portion of a torso opening, a right lateral side and a left lateral side, and a front portion having a right front portion 102*a* configured to cover a right side of the wearer torso and having a lateral side connected directly or indirectly to the right lateral side of the back panel and a left front portion 102*b* configured to cover a left side of the wearer torso and having a lateral side connected directly or indirectly to the left lateral side of the back panel. The right and the left front portions 102*a* and 102*b* connected to the back portion 104 to form the body with corresponding right and left arm openings and torso opening. The right front portion and the left front portion being separated and forming a front opening of the body to allow the wearer to put the garment on or to remove it. The right front portion 102*a* including a right chest panel 108*a* and a right abdomen panel 110*a*, the right chest panel 108*a* and the right abdomen panel 110*a* each being connected directly or indirectly to the right lateral side of the back panel along at least part of their respective lateral sides and each having a respective top edge, a bottom edge, and a medial edge. The left front portion 102*b* including a left chest panel 108*b* and a left abdomen panel 110*b*, the left chest panel 108*b* and the left abdomen panel 110*b* each being connected directly or indirectly to the left lateral side of the back panel along at least part of their respective lateral sides and each having a respective top edge, a bottom edge, and a medial edge. The support garment 100 further including an adjustable chest fastener 112 configured to link the right chest panel 108*a* and the left chest panel 108*b* bringing the right chest panel 108*a* and left chest panel 108*b* from an open configuration to a closed configuration and an adjustable abdomen fastener 114 configured to link the right abdomen panel 110*a* and the left abdomen panel 110*b* bringing the right abdomen panel 110*a* and left abdomen panel 110*b* from an open configuration to a closed configuration.

In some embodiments, the right abdomen panel 110*a* is configured to at least partially overlay the right chest panel 108*a* and the left abdomen panel 110*b* is configured to overlay the left chest panel 108*b*.

In some embodiments, the right chest panel 108*a* is configured to at least partially overlay the right abdomen panel 110*a* and the left chest panel 108*b* is configured to overlay the left abdomen panel 110*b*.

In some embodiments, the right abdomen panel 110*a* is attached to the right chest panel 108*a* such that the top edge of the right abdomen panel 110*a* at least partially overlaps the bottom edge of the right chest panel 108*a* and left abdomen panel 110*b* is attached to the left chest panel 108*b* such that the top edge of the left abdomen panel 110*b* at least partially overlaps the bottom edge of the left chest panel 108*b*.

In some embodiments, the right abdomen panel 110*a* is attached to the right chest panel 108*a* such that the bottom edge of the right chest panel 108*a* at least partially overlaps the top edge of the right abdomen panel 110*a* and left abdomen panel 110*b* is attached to the left chest panel 108*b* such that the bottom edge of the left chest panel 108*b* at least partially overlaps the top edge of the left abdomen panel 110*b*.

In some embodiments, the chest fastener 112 includes a right chest fastening element coupled to the medial edge of the right chest panel 108*a* of the right front portion 102*a* and a left chest fastening element coupled to the medial edge of the left chest panel 108*b* of the left front portion 102*b*, the right chest fastening element being configured to engage the left chest fastening element and to disengage the left chest fastening element to separate and bring the right chest panel 108*a* and the left chest panel 108*b* in open configuration, the chest fastener 112 further including a chest adjusting element coupled to the right and/or the left chest fastening element to adjust a position of the chest fastener along the medial edges of the right and left chest panels 108*a* and 108*b* or to adjust a closeness of the right and the left chest panels 108*a* and 108*b* when in the closed position, and the abdomen fastener 114 including a right abdomen fastening element coupled to the medial edge of the right abdomen panel 110*a* of the right front portion 102*a* and a left abdomen fastening element coupled to the medial edge of the left abdomen panel 110*b* of the left front portion 102*b*, the right abdomen fastening element being configured to engage the left abdomen fastening element and to disengage the left abdomen fastening element to separate and bring the right abdomen panel 110*a* and the left abdomen panel 110*b* in open configuration, the abdomen fastener 114 further including an abdomen adjusting element coupled to the right and/or the left abdomen fastening element to adjust a position of the abdomen fastener 114 along the medial edges of the right and left abdomen panels 110*a* and 110*b* or to adjust a closeness of the right and the left abdomen panels 110*a* and 110*b* when in the closed position.

In some embodiments, the support garment 100 further includes a right chest rail 109*a* connected to the right chest panel 108*a* in proximity to the medial edge of the right chest panel 108*a* and a left chest rail 109*b* connected to the left chest panel 108*b* in proximity to the medial edge of the left chest panel 108*b*, the right chest fastening element of the chest fastener 112 slidably mounted to the right chest rail 109*a* and the left chest fastening element of the chest fastener 112 slidably mounted to the left chest rail 109*b*, the position of the chest fastener 112 adjusted by sliding the right chest fastening element along the right chest rail 109*a* and sliding the left chest fastening element along the left chest rail 109*b*.

In some embodiments, the support garment further includes a right abdomen rail 111*a* connected to the right abdomen panel 110*a* in proximity to the medial edge of the right abdomen panel 110*a* and a left abdomen rail 111*b* connected to the left abdomen panel 110*b* in proximity to the medial edge of the left abdomen panel 110*b*, the right abdomen fastening element of the abdomen fastener 114 slidably mounted to the right abdomen rail 111*a* and the left abdomen fastening element of the abdomen fastener 114 slidably mounted to the left abdomen rail 111*b*, the position of the abdomen fastener 114 adjusted by sliding the right abdomen fastening element along the right abdomen rail 111*a* and sliding the left abdomen fastening element along the left abdomen rail 111*b*.

In some embodiments, the support garment 100 further includes at least one of a right side adjuster 116*a* having a first part connected to a lower portion of the right abdomen panel 110*a* and a second part positioned on a lower portion of the back panel and a left side adjuster 116*b* having a first part connected to a lower portion of the left abdomen panel 110*b* and a second part positioned on the lower portion of the back panel, the right and the left side adjusters 116*a* and 116*b* being configured to fit the front and back portions 102*a*, 102*b*, and 104.

In some embodiments, the back panel includes an outer panel and an inner panel, the outer and the inner panels connected to form a back pocket bag 118 and 119 therein between with an access opening, the back pocket 118 and 119 bag configured to store items.

In some embodiments, the back panel further includes at least one securing retainer to secure the items when positioned in the back pocket bag 118 and 119.

In some embodiments, the outer panel is a pocket panel connected to the inner panel to form the back pocket bag 118 and 119.

In some embodiments, the at least one securing retainer is coupled to the back inner panel and/or the back outer panel in proximity to the access opening.

In some embodiments, the inner panel includes an absorbent material.

In some embodiments, an outer surface of the outer panel includes a reflective material.

In some embodiments, the inner panel includes a mesh.

In some embodiments, the support garment 100 further includes one or more front pocket panels connected to at least one of the right chest panel 108*a*, the left chest panel 108*b*, the right abdomen panel 110*a*, and the left abdomen panel 110*b*, each front pocket panel forming a front pocket bag and an entrance opening of the front pocket bag.

In some embodiments, an inner panel of the front pocket bag includes an absorbent material.

In some embodiments, an outer surface of the one or more front pocket panels includes a reflective material.

In some embodiments, an inner panel of the front pocket bag includes a mesh.

In some embodiments, the support garment 100 further includes a right side panel 106*a* having a top side forming portion of the right arm opening, a bottom side forming portion of the torso opening, a first side connected to the lateral side of the right abdomen panel 110*a* and a second side connected to a portion of the right lateral side of the back panel, and a left side panel 106*b* having a top side forming portion of the left arm opening, a bottom side forming portion of the torso opening, a first side connected to the lateral side of the left abdomen panel 110*b* and a second side connected to a portion of the left lateral side of the back panel.

In some embodiments, the support garment 100 further includes at least one of a right side pocket panel connected to the right side panel 106*a* to form a right side pocket bag and a left side pocket panel connected to the left side panel 106*b* to form a left side pocket bag.

In some embodiments, an inner panel of the right side pocket bag and/or the left side pocket bag includes an absorbent material.

In some embodiments, an outer surface of the right side pocket panel and/or the left side pocket panel includes a reflective material.

In some embodiments, an inner panel of the right side pocket bag and/or the left side pocket bag includes a mesh.

In some embodiments, the garment 100 is a vest, a jacket, a shirt, a life-vest, a harness, or a coat.

In some embodiments, the garment 100 is an athletic vest.

In some embodiments, the garment 100 further includes a left sleeve and a right sleeve.

According to an aspect, there is provided a temperature control athletic garment 100 including a back portion 104 configured to cover a portion of a back of a wearer torso and comprising at least one back panel with a top side forming a portion of a neck opening, a bottom side forming a portion of a torso opening, a right lateral side and a left lateral side, and a front portion having a right front portion 102*a* configured to cover a right side of the wearer torso and having a lateral side connected directly or indirectly to the right lateral side of the back panel, and a left front portion 102*b* configured to cover a left side of the wearer torso and having a lateral side connected directly or indirectly to the left lateral side of the back panel. The right and the left front portions 102*a* and 102*b* connected to the back portion 104 to form a garment body with corresponding right and left arm openings and torso opening. The right front portion 102*a* and the left front portion 102*b* being separated and forming a front opening of the garment body to allow the wearer to put the garment on or to remove it. The right front portion 102*a* including a right chest panel 108*a* and a right abdomen panel 110*a*, the right chest panel 108*a* and the right abdomen panel 110*a* each being connected directly or indirectly to the right lateral side of the back panel along at least part of their respective lateral sides and each having a respective top edge, a bottom edge and a medial edge. The left front portion 102*b* including a left chest panel 108*b* and a left abdomen panel 110*b*, the left chest panel 108*b* and the left abdomen panel 110*b* each being connected directly or indirectly to the left lateral side of the back panel along at least part of their respective lateral sides and each having a respective top edge, a bottom edge, and a medial edge. The athletic garment 100 further including an adjustable chest fastener 112 configured to link the right chest panel 108*a* and the left chest panel 108*b* bringing the right chest panel 108*a* and left chest panel 108*b* from an open configuration to a closed configuration, an adjustable abdomen fastener 114 configured to link the right abdomen panel 110*a* and the left abdomen panel 110*b* bringing the right abdomen panel 110*a* and left abdomen panel 110*b* from an open configuration to a closed configuration, and at least one pocket bag formed at least in at least one of the at least one back panel, the right chest panel 108*a*, the right abdomen panel 110*a*, the left chest panel 108*b*, and the left abdomen panel 110*b*, the at least one pocket bag having an access opening and configured to store at least one thermal regulating element.

In some embodiments, the right abdomen panel 110*a* is configured to at least partially overlay the right chest panel 108*a* and the left abdomen panel 110*b* is configured to overlay the left chest panel 108*b*.

In some embodiments, the right chest panel 108*a* is configured to at least partially overlay the right abdomen panel 110*a* and the left chest panel 108*b* is configured to overlay the left abdomen panel 110*b*.

In some embodiments, the right abdomen panel 110*a* is attached to the right chest panel 108*a* such that the top edge of the right abdomen panel 110*a* at least partially overlaps the bottom edge of the right chest panel 108*a* and left abdomen panel 110*b* is attached to the left chest panel 108*b* such that the top edge of the left abdomen panel 110*b* at least partially overlaps the bottom edge of the left chest panel 108*b*.

In some embodiments, the right abdomen panel 110*a* is attached to the right chest panel 108*a* such that the bottom edge of the right chest panel 108*a* at least partially overlaps the top edge of the right abdomen panel 110*a* and left abdomen panel 110*b* is attached to the left chest panel 108*b* such that the bottom edge of the left chest panel 108*b* at least partially overlaps the top edge of the left abdomen panel 110*b*.

In some embodiments, the chest fastener 112 includes a right chest fastening element coupled to the medial edge of the right chest panel 108*a* of the right front portion 102*a* and a left chest fastening element coupled to the medial edge of the left chest panel 108*b* of the left front portion 102*b*, the right chest fastening element being configured to engage the left chest fastening element and to disengage the left chest fastening element to separate and bring the right chest panel 108*a* and the left chest panel 108*b* in open configuration, the chest fastener 112 further comprising a chest adjusting element coupled to the right and/or the left chest fastening element to adjust a position of the chest fastener 112 along the medial edges of the right and left chest panels 108*a* and 108*b* or to adjust a closeness of the right and the left chest panels 108*a* and 108*b* when in the closed position, and the abdomen fastener 114 includes a right abdomen fastening element coupled to the medial edge of the right abdomen panel 110*a* of the right front portion 102*a* and a left abdomen fastening element coupled to the medial edge of the left abdomen panel 110*b* of the left front portion 102*b*, the right abdomen fastening element being configured to engage the left abdomen fastening element and to disengage the left abdomen fastening element to separate and bring the right abdomen panel and the left abdomen panel in open configuration, the abdomen fastener 114 further comprising an abdomen adjusting element coupled to the right and/or the left abdomen fastening element to adjust a position of the abdomen fastener 114 along the medial edges of the right and left abdomen panels 110*a* and 110*b* or to adjust a closeness of the right and the left abdomen panels 110*a* and 110*b* when in the closed position.

In some embodiments, the garment 100 further includes a right chest rail connected to the right chest panel 108*a* in proximity to the medial edge of the right chest panel 108*a* and a left chest rail connected to the left chest panel 108*b* in proximity to the medial edge of the left chest panel 108*b*, the right chest fastening element of the chest fastener 112 slidably mounted to the right chest rail and the left chest fastening element of the chest fastener 112 slidably mounted to the left chest rail, the position of the chest fastener 112 adjusted by sliding the right chest fastening element along the right chest rail and sliding the left chest fastening element along the left chest rail.

In some embodiments, the garment 100 further includes a right abdomen rail connected to the right abdomen panel 110*a* in proximity to the medial edge of the right abdomen panel 110*a* and a left abdomen rail connected to the left abdomen panel 110*b* in proximity to the medial edge of the left abdomen panel 110*b*, the right abdomen fastening element of the abdomen fastener 114 slidably mounted to the right abdomen rail and the left abdomen fastening element of the abdomen fastener 114 slidably mounted to the left abdomen rail, the position of the abdomen fastener 114 adjusted by sliding the right abdomen fastening element along the right abdomen rail and sliding the left abdomen fastening element along the left abdomen rail.

In some embodiments, the garment 100 further includes at least one of a right side adjuster 116*a* having a first part connected to a lower portion of the right abdomen panel 110*a* and a second part positioned on a lower portion of the back panel and a left side adjuster 116*b* having a first part connected to a lower portion of the left abdomen panel 110*b* and a second part positioned on the lower portion of the back panel, the right and the left side adjusters 116*a* and 116*b* being configured to fit the front and back portions.

In some embodiments, the back panel comprises an outer panel and an inner panel, the outer and the inner panels connected to form a back pocket bag 118 and 119 therein between with an access opening, the back pocket bag 118 and 119 configured to store items.

In some embodiments, the back panel further includes at least one securing retainer to secure the items when positioned in the back pocket bag 118 and 119.

In some embodiments, the outer panel is a pocket panel connected to the inner panel to form the back pocket bag 118 and 119.

In some embodiments, the at least one securing retainer is coupled to the back inner panel and/or the back outer panel in proximity to the access opening.

In some embodiments, the inner panel includes an absorbent material.

In some embodiments, an outer surface of the outer panel includes a reflective material.

In some embodiments, the inner panel includes a mesh.

In some embodiments, the garment 100 further includes one or more front pocket panels connected to at least one of the right chest panel 108*a*, the left chest panel 108*b*, the right abdomen panel 110*a*, and the left abdomen panel 110*b*, each front pocket panel forming a front pocket bag and an entrance opening of the front pocket bag.

In some embodiments, an inner panel of the front pocket bag includes an absorbent material.

In some embodiments, an outer surface of the one or more front pocket panels includes a reflective material.

In some embodiments, an inner panel of the front pocket bag includes a mesh.

In some embodiments, the garment 100 further includes a right side panel 106*a* having a top side forming portion of the right arm opening, a bottom side forming portion of the torso opening, a first side connected to the lateral side of the right abdomen panel 110*a* and a second side connected to a portion of the right lateral side of the back panel, and a left side panel 106*b* having a top side forming portion of the left arm opening, a bottom side forming portion of the torso opening, a first side connected to the lateral side of the left abdomen panel 110*b* and a second side connected to a portion of the left lateral side of the back panel.

In some embodiments, the garment further includes at least one of a right side pocket panel connected to the right side panel 106*a* to form a right side pocket bag and a left side pocket panel connected to the left side panel 106*b* to form a left side pocket bag.

In some embodiments, an inner panel of the right side pocket bag and/or the left side pocket bag includes an absorbent material.

In some embodiments, an outer surface of the right side pocket panel and/or the left side pocket panel includes a reflective material.

In some embodiments, an inner panel of the right side pocket bag and/or the left side pocket bag includes a mesh.

In some embodiments, the garment 100 is a vest, a jacket, a shirt, a life-vest, a harness, or a coat.

In some embodiments, the garment 100 is an athletic vest.

In some embodiments, the garment 100 further includes a left sleeve and a right sleeve.

Pocket Bags

Placement and Configuration

Figure 10B:
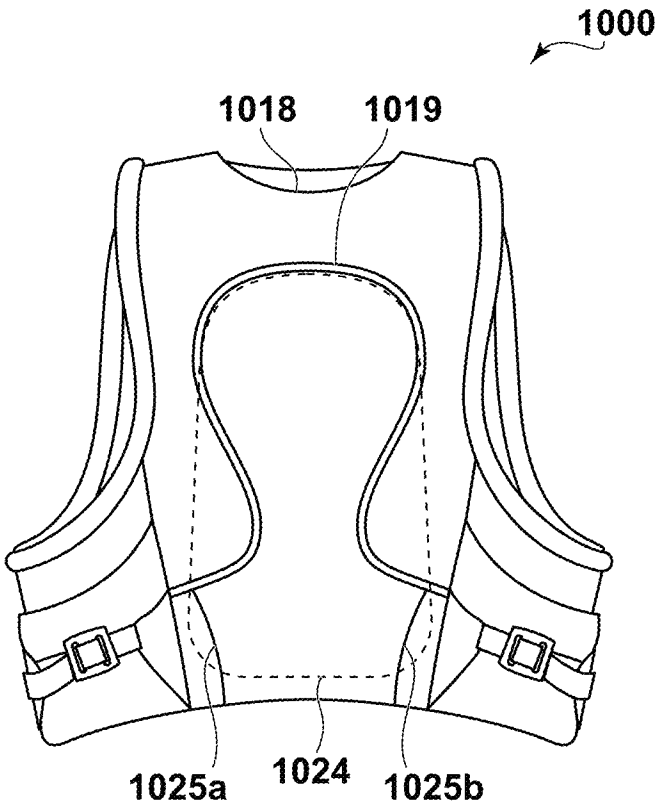
FIG. 10B illustrates a rear view of an athletic vest with back pocket bag placement illustrated, according to some embodiments.
Figure 10A:
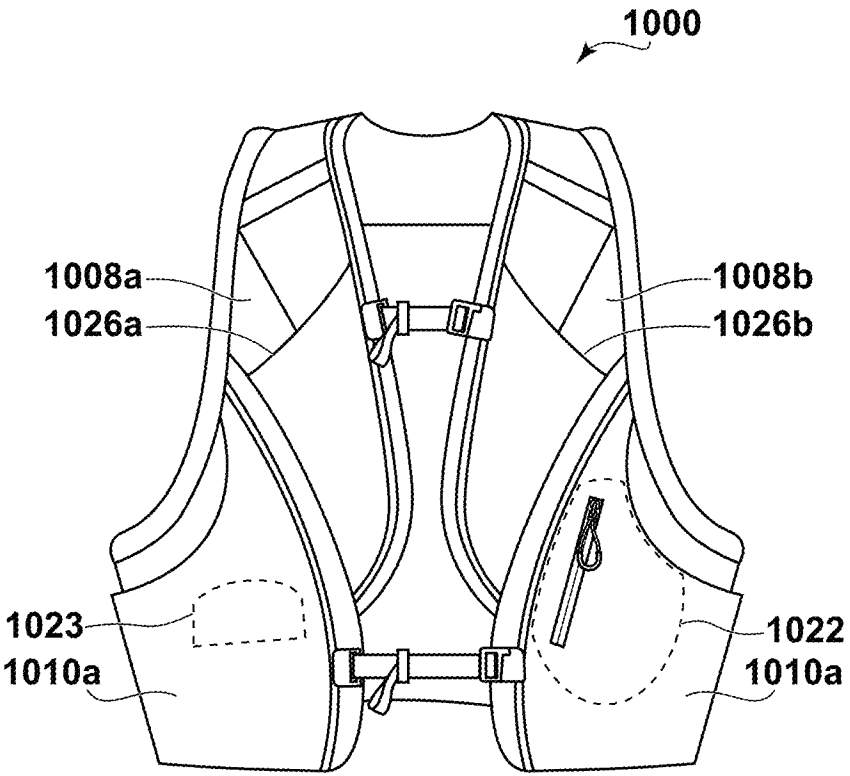
FIG. 10A illustrates a front view of an athletic vest with front pocket bag placement illustrated, according to some embodiments.

FIG. 10A illustrates a front view of an athletic vest 1000 with front pocket bag placement 1022 and 1023 illustrated, according to some embodiments.

In some embodiments, the chest panels 1008*a* and 1008*b* and/or the abdomen panels 1010*a* and 1010*b* may include pocket bags 1022 and 1023. For example, the left abdomen panel 1010*b* may include a pocket bag 1022. In such embodiments, the abdomen panel 1010*b* may be made up of an interior panel and exterior panel. The pocket bag 1022 may be formed by the space between the two panels. In some, embodiments, the pocket bag 1022 may be formed by connecting a pocket panel to the abdomen panel. For example, as illustrated in FIGS. 10A and 10B, the pocket panel is connected to the abdomen panel along its bottom edge, in proximity to its medial edge and along a portion of its lateral edge. The top side of the pocket bag is at least partially unattached to provide entrance opening to access the pocket bag. In some embodiments, the right abdomen panel 1010*a* may include a smaller inner pocket 1023 sewn on the inside of the right abdomen panel 1010*a*. The Skilled Person would understand that these pocket bags 1022 and 1023 could equally be applied to other panels (e.g., chest panels) or elsewhere on the athletic vest 1000. Other pocket bag designs (e.g., mesh with pockets stitched therein) may also be applied.

In some embodiments, the chest panels 1008*a* and 1008*b* may include pocket bags 1026*a* and/or 1026*b*. In some, embodiments, the pocket bags 1026*a* and 1026*b* may be formed by connecting a pocket panel to the abdomen panel. For example, as illustrated in FIG. 10A, the pocket panel is connected to the chest panel along its bottom edge, in proximity to its medial edge and along a portion of its lateral edge. The top side of the pocket bag is at least partially unattached to provide entrance opening to access the pocket bag. Other pocket bag designs (e.g., mesh with pockets stitched therein) may also be applied.

In some embodiments the one or more of the pocket bags 1022, 1023, 1026*a* and 1026*b* may be divided into multiple pocket bags. This may be achieved by bonding, for example, the pocket panel to relevant front panel (e.g., the chest panels 1008*a* and 1008*b* and abdomen panels 1010*a* and 1010*b*) at a medial region of the pocket bag to form two pocket bags. Other methods of subdividing the pocket bags may also be used. Furthermore, the athletic vest 1000 may be constructed with multiple pocket bags built into the panels separately.

FIG. 10B illustrates a rear view of an athletic vest 1000 with back pocket bag placement 1024 illustrated, according to some embodiments.

In some embodiments, the back portion may include a first back pocket bag 1018, second back pocket bag 1019, and openings 1025*a*, and 1025*b*. For example, the second back pocket 1019 may include a pocket bag 1024. In such embodiments, the back portion may be made up of an interior panel and exterior panel. The pocket bag 1024 may be formed by the space between the two panels. In some embodiments, the back panel may also or alternatively include a hollow interior between the openings 1025*a* and 1025*b* in which the user may store items. For example, user can use the storage space formed therein to store hiking poles, or pull a towel there through. The Skilled Person would understand that these pocket bags could equally be applied to other panels (e.g., chest panels) or elsewhere on the athletic vest 1000.

FIG. 11A, FIG. 11B, FIG. 11C, and FIG. 11D each illustrate a front view 1100, 1120, 1140, 1160 and profile view 1110, 1130, 1150, 1170 of a pocket bag finishing option, according to some embodiments.

Figure 11A:
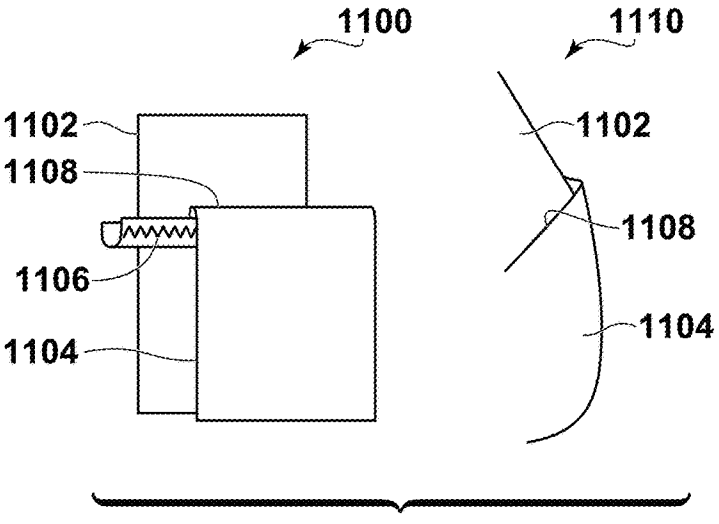
FIG. 11A, FIG. 11B, FIG. 11C, and FIG. 11D each illustrate a front view and profile view of a pocket bag finishing option, according to some embodiments.

Referring to FIG. 11A, the garment described herein may include a pocket bag. The pocket bag may be formed between a garment's panel 1102 and a pocket panel 1104. In one embodiment, the pocket bag may be formed between an interior panel and an exterior panel of the garment. The pocket opening may be secured by an elastic binding 1106. The elastic binding 1106 can be positioned just under the fold 1108 to produce a clean finish at the top edge of the pocket bag.

Figure 11B:
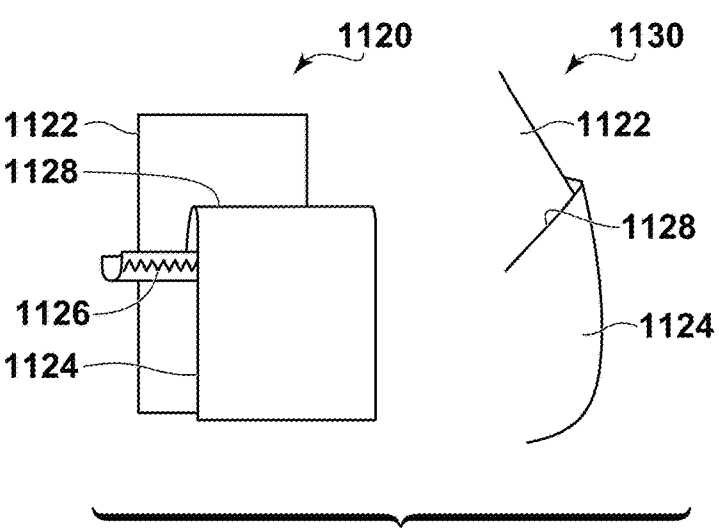

Referring to FIG. 11B, the garment described herein may include a pocket bag. The pocket bag may be formed between an interior panel 1122 and an exterior panel 1124. The pocket opening may be secured by an elastic binding 1126. The elastic binding 1126 can be positioned further under the fold 1128 as compared with that of FIG. 11A to produce a clean finish at the top edge of the pocket bag.

Figure 11C:
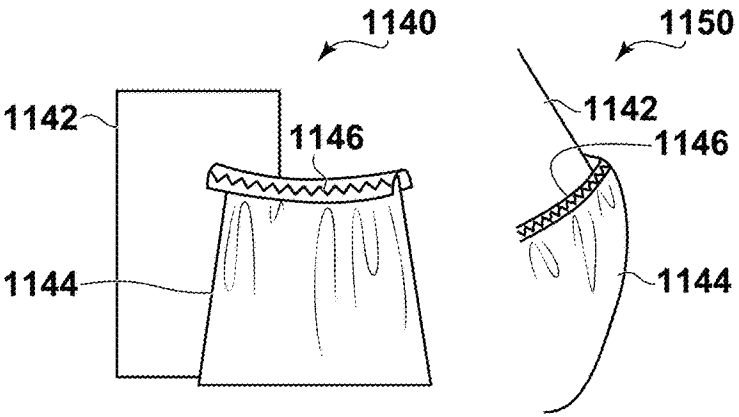

Referring to FIG. 11C, the garment described herein may include a pocket bag. The pocket bag may be formed as a pocket 1144 on an interior panel 1142. The pocket opening may be secured by an elastic binding 1146. The elastic binding 1146 can make up the fold of the pocket bag giving the pocket panel 1144 a ruffled look.

Figure 11D:
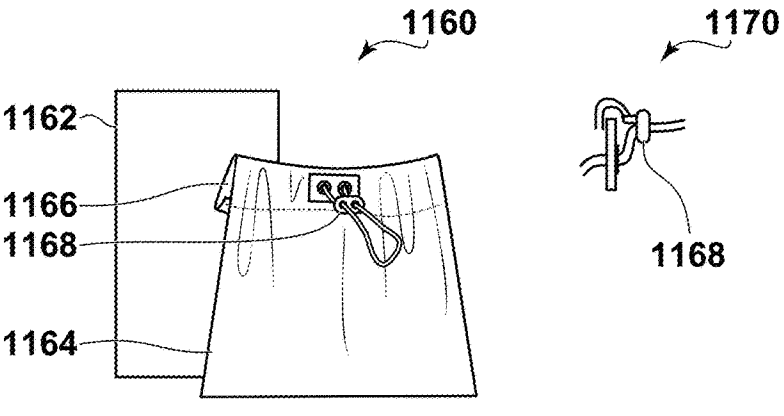

Referring to FIG. 11D, the garment described herein may include a pocket bag. The pocket bag may be formed as a pocket 1164 on an interior panel 1162. The pocket opening may be secured by a drawstring 1166. The drawstring 1166 can be positioned within a region proximate to the top edge of the pocket 1164 and further defined by, for example, a coverstitch (e.g., in a channel defined by the coverstitch). The drawstring 1166 may be adjustable using adjustor 1168.

Any or all of the above pockets may be used to secure items. Some of those items may be snacks, water bottles, or other personal belongings. The elastic openings may be configured to secure the items inside (e.g., a user's mobile phone or other snacks) or may be configured to wrap around the item and keep it in place while the item extends out of the pocket (e.g., a water bottle who's top extends out of the top of the pocket). In some embodiments the pockets may be configured to hold other items such as heating or cooling features.

Referring to FIG. 1A, the right chest panel 108*a*, left chest panel 108*b*, right abdomen panel 110*a*, and left abdomen panel 110*b* may each include a pocket bag. In some embodiments, these pocket bags may be installed elsewhere on the athletic vest 100.

Referring to FIG. 10A and FIG. 10B, according to an aspect, there is provided a support garment 1000 including a body configured to cover at least portion of a torso of a wearer and having an outer surface and an inner surface, the inner surface facing the wearer torso. The body comprising a back portion having a back panel with a top side forming a portion of a neck opening, a bottom side forming a portion of a torso opening, a right lateral side and a left lateral side, and a front portion having at least one front panel with a top side forming a portion of a neck opening, a bottom side forming a portion of a torso opening, a right lateral side and a left lateral side. The right lateral sides of the front and back portions joined directly or indirectly forming a right arm opening. The left lateral sides of the front and back portions joined directly or indirectly forming a left arm opening. The support garment further including at least one pocket bag 1022, 1023, 1026*a*, 1026*b*, 1018, and 1019 formed at least in the support garment, the at least one pocket bag 1022, 1023, 1026*a*, 1026*b*, 1018, and 1019 having an access opening and configured to store at least one thermal regulating element.

In some embodiments, the support garment 1000 further includes at least one of a right side adjuster having a first part connected to a right lower portion of the front panel and a second part positioned on a right lower portion of the back panel and a left side adjuster having a first part connected to a left lower portion of the front panel and a second part positioned on the left lower portion of the back panel, the right and the left side adjusters being configured to fit the front and back panels.

In some embodiments, the at least one pocket bag 1018 and 1019 is formed from an outer panel and an inner panel of the back panel, the outer and the inner panels connected to form the at least one pocket bag therein between with an access opening.

In some embodiments, the back panel further includes at least one securing retainer to secure the items when positioned in the at least one pocket bag.

In some embodiments, the at least one securing retainer is coupled to the back inner panel and/or the back outer panel in proximity to the access opening.

In some embodiments, an inner panel of the at least one pocket bag 1018 and 1019 includes an absorbent material.

In some embodiments, an outer surface of the at least one pocket bag 1018 and 1019 includes a reflective material.

In some embodiments, an inner panel of the at least one pocket bag 1018 and 1019 comprises a mesh.

In some embodiments, the support garment 1000 further includes a right side panel having a top side forming portion of the right arm opening, a bottom side forming portion of the torso opening, a first side connected to the right lateral side of the front panel and a second side connected to the right lateral side of the back panel, and a left side panel having a top side forming portion of the left arm opening, a bottom side forming portion of the torso opening, a first side connected to the left lateral side of the front panel and a second side connected to a portion of the left lateral side of the back panel.

In some embodiments, the support garment 1000 further includes at least one of a right side pocket panel connected to the right side panel 1008*a* to form the at least one pocket bag 1026*a* and a left side pocket panel connected to the left side panel 1008*b* to form the at least one pocket bag 1026*b*.

In some embodiments, the garment 1000 is a vest, a jacket, a shirt, a life-vest, a harness, or a coat.

In some embodiments, the garment 1000 is an athletic vest.

In some embodiments, the garment 1000 further includes a left sleeve and a right sleeve.

Removable Pouches

Figure 12:
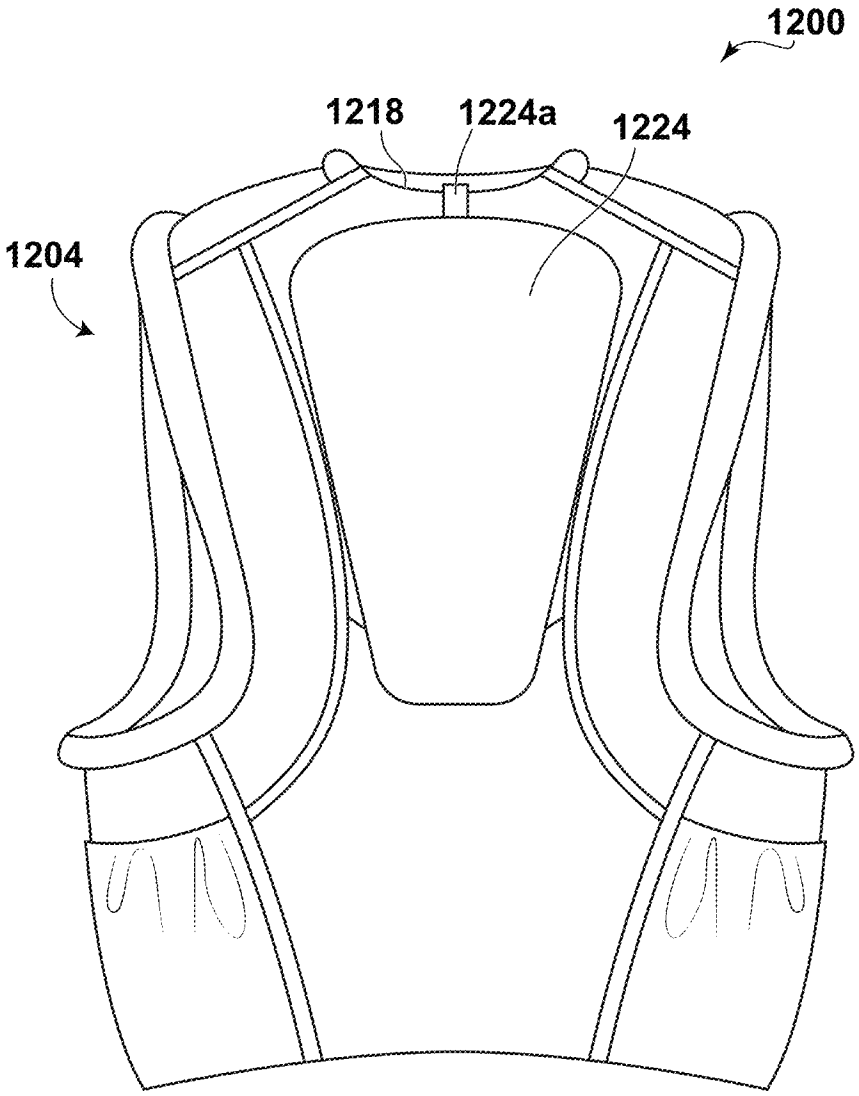
FIG. 12 illustrates an rear view of an athletic vest with a removable pouch, according to some embodiments.

FIG. 12 illustrates an rear view of an athletic vest 1200 with a removable pouch 1224, according to some embodiments.

In some embodiments, the athletic vest 1200 may be configured to receive a removable pouch 1224 in the back portion 1204. The first back pocket 1218*a* may be configured to receive the removable pouch 1224. The removable pouch 1224 may be configured to couple with the athletic vest 1200, for example through attachment portion 1224*a*.

Figure 13B:
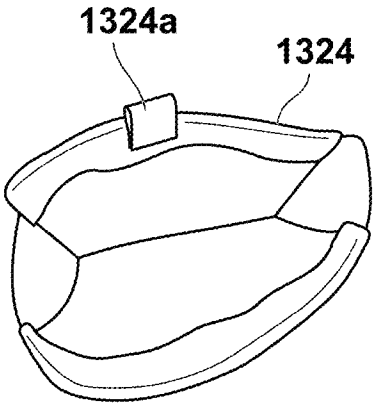
FIG. 13B illustrates a top view of a removable pouch, according to some embodiments.
Figure 13A:
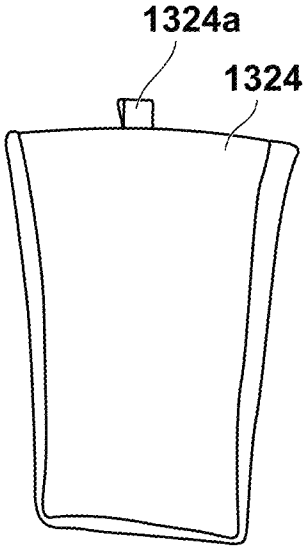
FIG. 13A illustrates a front view of a removable pouch, according to some embodiments.

FIG. 13A illustrates a front view of a removable pouch 1324, according to some embodiments.

FIG. 13B illustrates a top view of a removable pouch 1324, according to some embodiments.

The above figures illustrate another example embodiment of a removable pouch 1324. The removable pouch may have an attachment portion 1324*a*. The removable pouch may include an opening in the top to receive items such as, for example, ice. Such a removable pouch may be advantageous for an insert in the back portion of the vest. Such a removable pouch may additionally advantageous elsewhere.

The removable pouches 1224 and 1324 may be configured as a cooling element (e.g., an item frozen or cooled in advanced before being put into the athletic vest 1200). In some embodiments, the removable pouches 1224 and 1324 may be configured to receive ice. In such embodiments, the removable pouches 1224 and 1324 may be configured with reflective layers to repel radiative energy (ensuring the ice absorbs heat from the user rather than from the lighting). The removable pouches 1224 and 1324 may be made of absorbent material. Ice will absorb heat from the user's body and melt to water. This water is still cold and capable to absorbing more heat. As such it may be beneficial for the removable pouches 1224 and 1324 to absorb the water as the ice melts to provide further cooling to a user and further to confine the melted water to specific regions rather than letting the water leak down the user.

Figure 14:
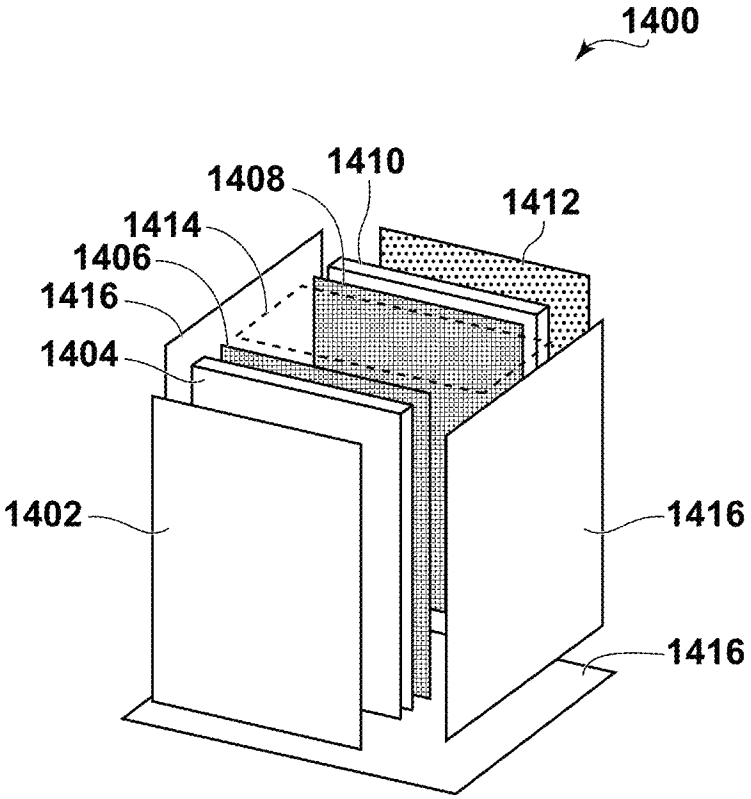
FIG. 14 illustrates a stack up for a removable pouch, according to some embodiments.

FIG. 14 illustrates a stack up 1400 for a removable pouch 1224 or 1324, according to some embodiments.

In some embodiments, the removable pouches 1224 or 1324 may include a stack up 1400 to help improve absorbency of melted ice and decrease melting due to radiative transmission of energy. The exterior layer 1402 may be made up of a reflective material with the reflective side facing out. This exterior layer 1402 can help reflect radiative energy from the lighting. This may ensure that more of the ice is absorbing heat from the user rather than the environment. Examples of a suitable exterior layer 1402 can include a synthetic flashspun high-density polyethylene fiber.

The second layer 1404 may include a super absorbent fabric. In some embodiments, the super absorbent fabric may be a highly absorbent non-woven fabric. In some embodiments, the super absorbent fabric comprises a microfiber. In some embodiments, the super absorbent fabric can be any material configured to absorb at least some liquid. In some embodiments, the super absorbent fabric may comprise a chemical absorbent (e.g., sodium polyacrylate). The super absorbent fabric may be configured to absorb water from the ice as it melts. This can help ensure that more of the water is retained in a specific region (i.e., within stack up 1400) rather than leaking elsewhere. The super absorbent fabric may also help enable the water to continue cooling the user by keeping the water relatively fixed and proximate to where the user would like cooling. In some embodiments, the super absorbent fabric may be configured to be soaked in water (or another liquid) prior to use. In some embodiments, the super absorbent fabric may be configured to be both soaked in water and subsequently frozen. In such embodiments, rather than or in addition to ice stored within the pouch, the frozen liquid in the superabsorbent fabric can cool the user as it melts and can further retain the water to further cool the user with the cool water.

The third layer 1406 may include a retaining material. This retaining material may hold the super absorbent fabric (e.g., in the second layer 1404) in place while permitting liquid (e.g., the water from melting ice) to pass through it. Examples of the retaining material can include power mesh.

The fourth layer 1408 can be another retaining material layer like the third layer 1406. Between the third layer 1406 and the fourth layer 1408 an opening for receiving items such as ice is formed.

The fifth layer 1410 can be another super absorbent fabric layer like the second layer 1404.

The internal layer 1412 can be the layer proximate to the user. This layer may be configured to effectively transfer heat from the user to the contents of the stack up 1400. The material for the internal layer 1412 may be selected to match the other material used in the vest or based on another consideration.

The sides and bottom 1416 can further define the opening within the stack up 1400. Like the internal layer 1412, the material that the sides and bottom 1416 may be selected to match the other material used in the vest or based on another consideration. In some embodiments, the sides and bottom 1416 can be made up of any of the materials as described above. In some embodiments, the sides and bottom 1416 are configured with the same layers 1402, 1404, 1406 with any possible variations as described above. Such embodiments, may fully surround any items (e.g., ice) with the stack up on all sides and may better capture any melted water.

The Skilled Person would understand that further variations of the stack up 1400 are possible. For example, in some embodiments of the stack up 110, the second layer 1404 may be omitted. In such embodiments, the absorbency would be left primarily to the fifth layer 1410 which is more proximate to the user. As such, such embodiments may be more effective at directing the cooling effects of any absorbed liquid (or frozen material) to the user.

Figure 15:
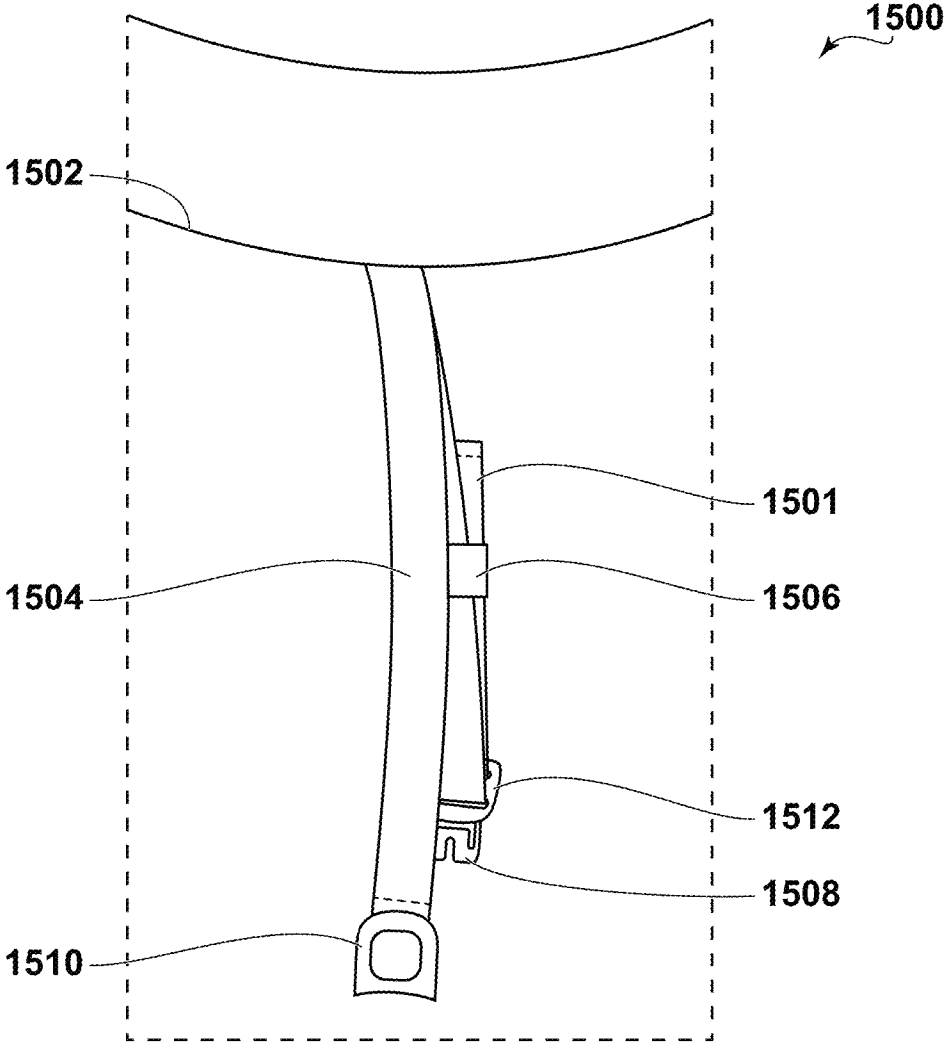
FIG. 15 illustrates a loop to interoperate with a removable pouch, according to some embodiments.

FIG. 15 illustrates a loop to interoperate with a removable pouch, according to some embodiments.

In some embodiments, one or more of the pocket bags (e.g., back pocket bags) may include an attachment that can interoperate with, for example, a removable pouch. Such attachments may be configured to secure the removable pouch more securely within the athletic vest.

For example, one or more pocket bags may include a strap 1500. The strap 1500 may be sewn within the pocket bag or on the outside of the pocket bag at one end 1501. The strap 1500 may then pass through a keeper 1506. The strap 1500 may then be equipped with an adjustor 1512 which may be used to adjust the length of the strap 1500. The strap may also include a male attachment element 1508 configured to interoperate with a female attachment element 1510. From the adjustor 1512, the strap 1500 may be configured to pass back through the keeper 1506 up to the edge of the pocket 1502 into which the strap 1500 may be sewn. The strap 1500 may then finally extend down to the female attachment element 1510.

The strap 1500 may be configured such that when the male attachment element 1508 and female attachment element 1510 interoperate, they can secure within a loop in another item such as at the attachment portions 1224*a* and 1324*a* of removable pouches 1224 and 1324.

Figure 16C:
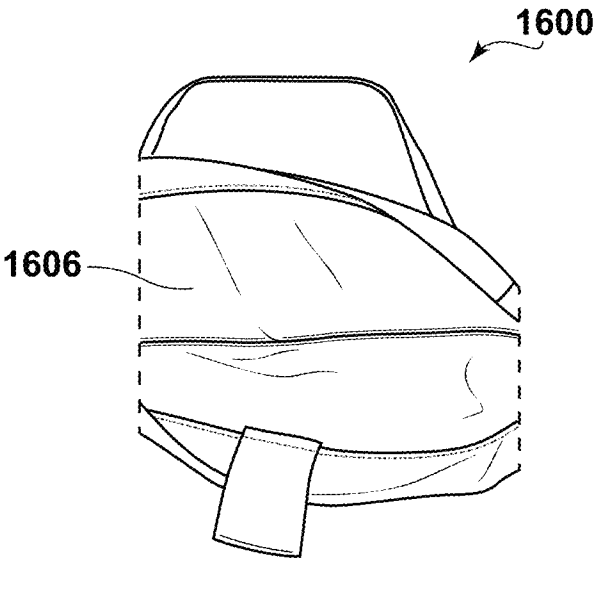
FIG. 16C illustrates an interior view of another removable pouch with a reflective sheet, according to some embodiments.
Figure 16B:
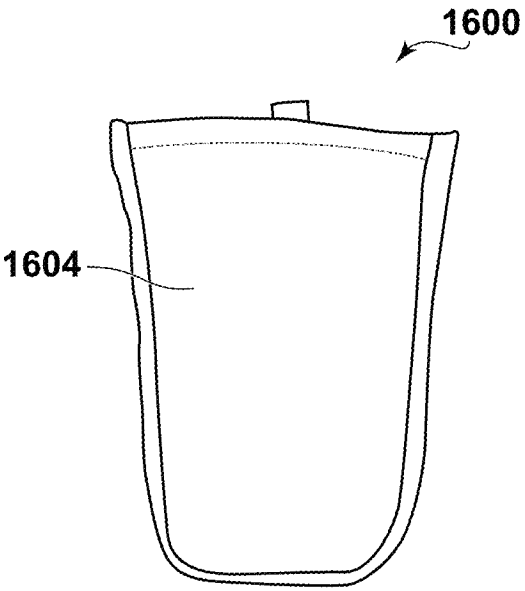
FIG. 16B illustrates a rear view of another removable pouch with a reflective sheet, according to some embodiments.
Figure 16A:
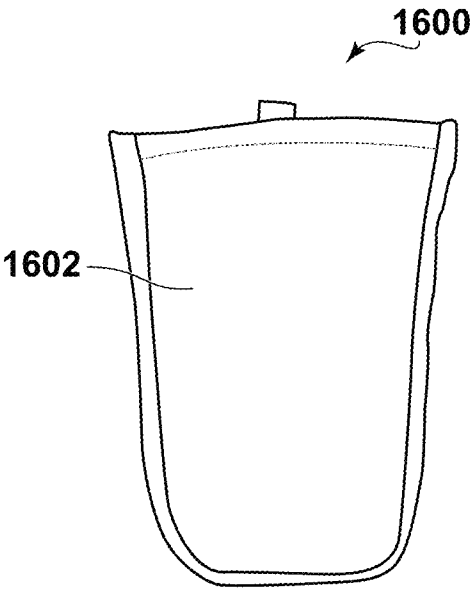
FIG. 16A illustrates a front view of another removable pouch with a reflective sheet, according to some embodiments.

FIG. 16A illustrates a front view of another removable pouch 1600 with a reflective sheet, according to some embodiments.

FIG. 16B illustrates a rear view of another removable pouch 1600 with a reflective sheet, according to some embodiments.

FIG. 16C illustrates an interior view of another removable pouch 1600 with a reflective sheet, according to some embodiments.

Removable pouch 1600 may include a reflective surface 1602. The reflective surface may be configured to reflect radiative energy from the environment away from the removable pouch. The removable pouch 1600 may also have an interior layer configured to, for example, transfer heat from the user to the contents of the removable pouch 1600 (e.g., water or ice) or vice versa from the contents of the removable pouch 1600 to the user (e.g., heating pads). In some embodiments, the removable pouch 1600 may, for example, be equipped with the stack up 1400 of FIG. 14. As such, the layer 1606 may be a retaining material to hold a super absorbent fabric.

Holding Elements

Figure 17B:
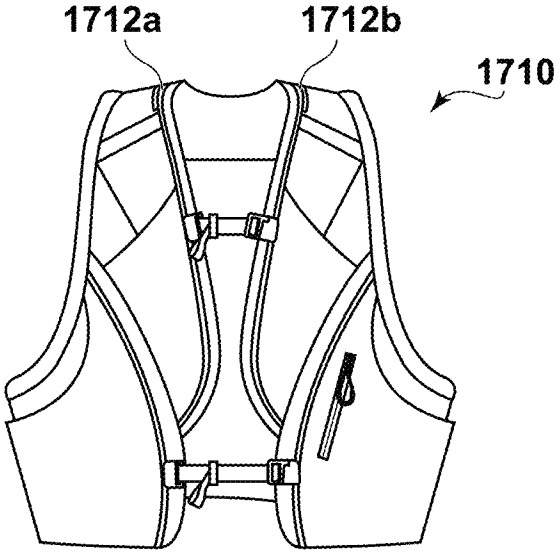
FIG. 17B illustrates an athletic vest with openings for hydration straws, according to some embodiments.
Figure 17A:
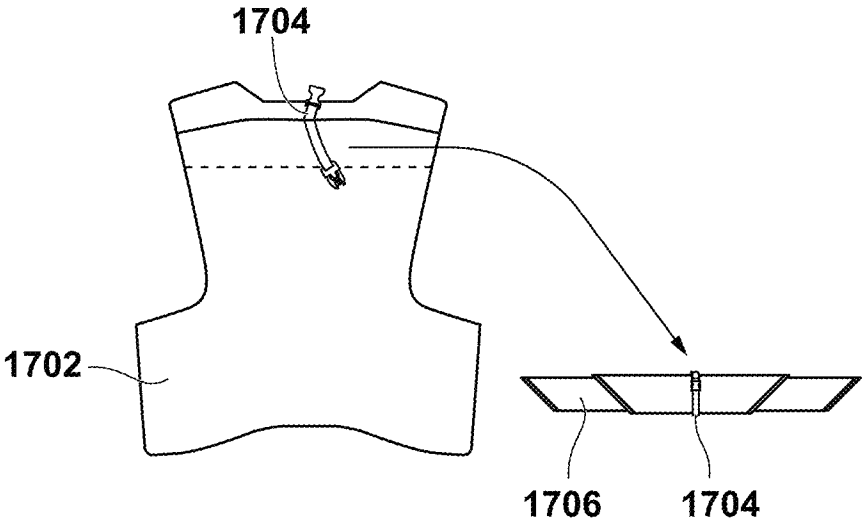
FIG. 17A illustrates an example holding element to hold a hydration pouch, super absorbent fabric, or an ice bandana, according to some embodiments.

FIG. 17A illustrates an example holding element 1702 (e.g., pocket or a panel) to hold a hydration pouch, super absorbent fabric, or an ice bandana, according to some embodiments.

The holding element 1702 may be configured to hold a hydration pouch which may be configured to hold a liquid such as water so that the user may drink water while wearing the vest (e.g., through a straw). The holding element 1702 may be sewn into an athletic vest 1710. The hydration pouch may be configured to fit inside the holding element 1702 of an embodiment of the vest. The holding element 1702 may further include an attachment point 1704. In some embodiments, the attachment point 1704 may be used to secure the hydration pouch within the holding element 1702. In some embodiments, the attachment point 1704 may be configured to hold other implements such as an ice bandana 1706 (e.g., a bandana filled with ice and wrapped generally around the user's neck).

FIG. 17B illustrates an athletic vest 1710 with openings 1712*a* and 1712*b* for hydration straws or hoses, according to some embodiments.

As described above, the hydration pouch may be configured to be stored within, for example, an holding element 1702 sewn into an athletic vest 1710. In such embodiments, the athletic vest 1710 may be configured with openings 1712*a* and/or 1712*b* to accommodate a hose/straw from the hydration pouch.

IMPLEMENTATION DETAILS

The foregoing discussion provides many example embodiments. Although each embodiment represents a single combination of inventive elements, other examples may include all possible combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

The terms "male" and "female", with reference to attachment components (fasteners, fastening elements, etc.), will be understood by the Skilled Person to be reversible without deviating from the embodiments described herein.

Although the embodiments have been described in detail, it should be understood that various changes, substitutions and alterations can be made herein without departing from the scope as defined by the appended claims.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be exemplary only. The scope is indicated by the appended claims.

What is claimed is:

1. A support garment comprising:

a body configured to cover at least a portion of a torso of a wearer and having an outer surface and an inner surface, the inner surface facing the wearer torso, the body comprising:

a back portion having a back panel with a top side forming a portion of a neck opening, a bottom side forming a portion of a torso opening, a right lateral side and a left lateral side, and a front portion comprising:

a right front portion configured to cover a right side of the wearer torso and having a lateral side connected directly or indirectly to the right lateral side of the back panel and a left front portion configured to cover a left side of the wearer torso and having a lateral side connected directly or indirectly to the left lateral side of the back panel, the right and the left front portions connected to the back portion to form the body with corresponding right and left arm openings and torso opening, the right front portion and the left front portion being separated and forming a front opening of the body to allow the wearer to put the garment on or to remove it, the right front portion comprising a right chest panel and a right abdomen panel, the right chest panel and the right abdomen panel each being connected directly or indirectly to the right lateral side of the back panel along at least part of their respective lateral sides and each having a respective top edge, a bottom edge, and a medial edge;

the left front portion comprising a left chest panel and a left abdomen panel, the left chest panel and the left abdomen panel each being connected directly or indirectly to the left lateral side of the back panel along at least part of their respective lateral sides and each having a respective top edge, a bottom edge, and a medial edge;

an adjustable chest fastener configured to link the right chest panel and the left chest panel bringing the right chest panel and left chest panel from an open configuration to a closed configuration;

an adjustable abdomen fastener configured to link the right abdomen panel and the left abdomen panel bringing the right abdomen panel and left abdomen panel from an open configuration to a closed configuration; and wherein right and left chest panels are at least partially separated from the right and left abdomen panels such that the adjustable chest fastener adjusts a fit of the right and left chest panels independently from the adjustable abdomen fastener that adjusts a fit of the right and left abdomen panels.

2. The support garment of claim 1, wherein the right abdomen panel is configured to at least partially overlay the right chest panel and the left abdomen panel is configured to overlay the left chest panel or the right chest panel is configured to at least partially overlay the right abdomen panel and the left chest panel is configured to overlay the left abdomen panel.

3. The support garment of claim 1, wherein:

the chest fastener comprising a right chest fastening element coupled to the medial edge of the right chest panel of the right front portion and a left chest fastening element coupled to the medial edge of the left chest panel of the left front portion, the right chest fastening element being configured to engage the left chest fastening element and to disengage the left chest fastening element to separate and bring the right chest panel and the left chest panel in open configuration, the chest fastener further comprising a chest adjusting element coupled to the right and/or the left chest fastening element to adjust a position of the chest fastener along the medial edges of the right and left chest panels or to adjust a closeness of the right and the left chest panels when in the closed position; and the abdomen fastener comprising a right abdomen fastening element coupled to the medial edge of the right abdomen panel of the right front portion and a left abdomen fastening element coupled to the medial edge of the left abdomen panel of the left front portion, the right abdomen fastening element being configured to engage the left abdomen fastening element and to disengage the left abdomen fastening element to separate and bring the right abdomen panel and the left abdomen panel in open configuration, the abdomen fastener further comprising an abdomen adjusting element coupled to the right and/or the left abdomen fastening element to adjust a position of the abdomen fastener along the medial edges of the right and left abdomen panels or to adjust a closeness of the right and the left abdomen panels when in the closed position.

4. The support garment of claim 3, further comprising a right chest rail connected to the right chest panel in proximity to the medial edge of the right chest panel and a left chest rail connected to the left chest panel in proximity to the medial edge of the left chest panel, the right chest fastening element of the chest fastener slidably mounted to the right chest rail and the left chest fastening element of the chest fastener slidably mounted to the left chest rail, the position of the chest fastener adjusted by sliding the right chest fastening element along the right chest rail and sliding the left chest fastening element along the left chest rail, and a right abdomen rail connected to the right abdomen panel in proximity to the medial edge of the right abdomen panel and a left abdomen rail connected to the left abdomen panel in proximity to the medial edge of the left abdomen panel, the right abdomen fastening element of the abdomen fastener slidably mounted to the right abdomen rail and the left abdomen fastening element of the abdomen fastener slidably mounted to the left abdomen rail, the position of the abdomen fastener adjusted by sliding the right abdomen fastening element along the right abdomen rail and sliding the left abdomen fastening element along the left abdomen rail.

5. The support garment of claim 1, further comprising at least one of a right side adjuster having a first part connected to a lower portion of the right abdomen panel and a second part positioned on a lower portion of the back panel and a left side adjuster having a first part connected to a lower portion of the left abdomen panel and a second part positioned on the lower portion of the back panel, the right and the left side adjusters being configured to fit the front and back portions.

6. The support garment of claim 1, wherein the back panel comprises an outer panel and an inner panel, the outer and the inner panels connected to form a back pocket bag therein between with an access opening, the back pocket bag configured to store items.

7. The support garment of claim 6, wherein the back panel further comprises at least one securing retainer to secure the items when positioned in the back pocket bag, the at least one securing retainer is coupled to the back inner panel and/or the back outer panel in proximity to the access opening.

8. The support garment of claim 6, wherein the back pocket bag is configured to store at least one thermal regulating element.

9. The support garment of claim 6, wherein the inner panel comprises an absorbent material.

10. The support garment of claim 6, wherein an outer surface of the outer panel comprises a reflective material.

11. The support garment of claim 1, further comprising one or more front pocket panels connected to at least one of the right chest panel, the left chest panel, the right abdomen panel, and the left abdomen panel, each front pocket panel forming a front pocket bag and an entrance opening of the front pocket bag.

12. The support garment of claim 11, wherein the front pocket bag is configured to store at least one thermal regulating element.

13. The support garment of claim 11, wherein an inner panel of the front pocket bag comprises an absorbent material.

14. The support garment of claim 11, wherein an outer surface of the one or more front pocket panels comprises a reflective material.

15. The support garment of claim 1, further comprising:

a right side panel having a top side forming portion of the right arm opening, a bottom side forming portion of the torso opening, a first side connected to the lateral side of the right abdomen panel and a second side connected to a portion of the right lateral side of the back panel, a left side panel having a top side forming portion of the left arm opening, a bottom side forming portion of the torso opening, a first side connected to the lateral side of the left abdomen panel and a second side connected to a portion of the left lateral side of the back panel, and at least one of a right side pocket panel connected to the right side panel to form a right side pocket bag and a left side pocket panel connected to the left side panel to form a left side pocket bag.

16. The support garment of claim 15, wherein an inner panel of the right side pocket bag and/or the left side pocket bag comprises an absorbent material.

17. The support garment of claim 15, wherein an outer surface of the right side pocket panel and/or the left side pocket panel comprises a reflective material.

18. The support garment of claim 15, wherein the right side pocket bag and the left side pocket bag are configured to store at least one thermal regulating element.

19. The support garment of claim 1, wherein the garment is a vest, an athletic vest, a jacket, a shirt, a tank top, a life-vest, a harness, or a coat.

* * * * *